US008407832B2

(12) United States Patent
Galley

(10) Patent No.: US 8,407,832 B2
(45) Date of Patent: Apr. 2, 2013

(54) INFANT SUPPORT STRUCTURE WITH A COLLAPSIBLE FRAME

(75) Inventor: Seth Galley, West Seneca, NY (US)

(73) Assignee: Mattel, Inc., El Segundo, CA (US)

( * ) Notice: Subject to any disclaimer, the term of this patent is extended or adjusted under 35 U.S.C. 154(b) by 453 days.

(21) Appl. No.: 12/568,170

(22) Filed: Sep. 28, 2009

(65) Prior Publication Data

US 2010/0107330 A1 May 6, 2010

Related U.S. Application Data

(60) Provisional application No. 61/109,778, filed on Oct. 30, 2008.

(51) Int. Cl.
*A47D 7/00* (2006.01)
*A47D 13/06* (2006.01)

(52) U.S. Cl. ..... 5/93.1; 5/97; 5/99.1; 5/102; 5/103; 5/201; 5/200.1

(58) Field of Classification Search ..... 5/93.1, 5/97, 98.1, 99.1, 101, 102, 103, 105, 655, 5/201, 200.1
See application file for complete search history.

(56) References Cited

U.S. PATENT DOCUMENTS

| | | | | | |
|---|---|---|---|---|---|
| 813,521 | A | * | 2/1906 | Reilly | 5/101 |
| 1,050,814 | A | * | 1/1913 | Demeree | 5/101 |
| 1,102,140 | A | * | 6/1914 | Collins | 5/101 |
| 2,287,907 | A | * | 6/1942 | Schettler, Jr. | 5/98.1 |
| 2,486,054 | A | * | 10/1949 | Morse | 5/99.1 |
| 2,716,557 | A | | 8/1955 | Gould et al. | |
| 2,866,495 | A | | 12/1958 | Diehl et al. | |
| 3,197,226 | A | | 7/1965 | Erlinder | |
| 3,364,507 | A | * | 1/1968 | Andersen | 5/103 |
| 3,459,423 | A | | 8/1969 | Meade | |
| 3,540,774 | A | | 11/1970 | Bailey | |
| 3,806,117 | A | | 4/1974 | Foster | |
| 4,359,244 | A | | 11/1982 | Koehm | |
| 4,805,902 | A | | 2/1989 | Casagrande | |
| 4,940,229 | A | | 7/1990 | Foster | |
| 4,948,120 | A | * | 8/1990 | Krueger et al. | 297/274 |
| 5,378,196 | A | | 1/1995 | Pinch et al. | |
| 5,803,817 | A | | 9/1998 | Stern | |
| 5,819,342 | A | * | 10/1998 | Williams | 5/99.1 |
| 6,027,409 | A | | 2/2000 | Favorito et al. | |
| 6,082,813 | A | * | 7/2000 | Chen | 297/16.2 |
| 6,125,483 | A | * | 10/2000 | Stroud et al. | 5/99.1 |
| 6,179,374 | B1 | * | 1/2001 | Tang | 297/45 |
| 6,256,814 | B1 | * | 7/2001 | Drobinski | 5/99.1 |
| 6,277,028 | B1 | | 8/2001 | Liu | |
| 6,386,986 | B1 | * | 5/2002 | Sonner et al. | 5/102 |
| 6,454,348 | B1 | * | 9/2002 | Wu | 297/16.2 |
| 6,516,823 | B1 | * | 2/2003 | Glover et al. | 5/99.1 |
| 6,520,862 | B1 | * | 2/2003 | Armbruster et al. | 472/118 |
| 6,645,080 | B1 | | 11/2003 | Greger et al. | |
| 6,857,966 | B2 | * | 2/2005 | Armbruster et al. | 472/118 |
| 6,887,161 | B2 | * | 5/2005 | Mahlstedt et al. | 472/119 |
| 6,896,624 | B2 | | 5/2005 | Longenecker et al. | |
| 6,902,489 | B2 | | 6/2005 | Greger et al. | |
| 7,052,403 | B2 | | 5/2006 | Ransil et al. | |
| 7,189,164 | B1 | * | 3/2007 | Paesang et al. | 472/118 |
| 7,252,594 | B2 | * | 8/2007 | Armbruster et al. | 5/93.1 |
| 7,258,617 | B2 | | 8/2007 | Chen | |

(Continued)

*Primary Examiner* — Robert G Santos
*Assistant Examiner* — David E Sosnowski
(74) *Attorney, Agent, or Firm* — Edell, Shapiro & Finnan, LLC

(57) ABSTRACT

An infant support structure with a collapsible frame is disclosed. In one embodiment, the infant support structure includes a frame with a coupling or lock mechanism that is configured to maintain the collapsible frame in a deployed or use configuration.

20 Claims, 24 Drawing Sheets

U.S. PATENT DOCUMENTS

| | | | | |
|---|---|---|---|---|
| 7,293,304 | B2 * | 11/2007 | Chen et al. | 5/99.1 |
| 7,600,276 | B2 * | 10/2009 | Chen et al. | 5/99.1 |
| 2006/0128483 | A1 | 6/2006 | Be | |
| 2006/0174406 | A1 * | 8/2006 | Yang | 5/99.1 |
| 2006/0185082 | A1 * | 8/2006 | Casati Troutman | 5/99.1 |
| 2007/0049390 | A1 | 3/2007 | Wu et al. | |
| 2007/0060405 | A1 | 3/2007 | Grossman et al. | |
| 2008/0196162 | A1 * | 8/2008 | Yul et al. | 5/97 |

* cited by examiner

INFANT SUPPORT STRUCTURE WITH A COLLAPSIBLE FRAME

CROSS-REFERENCE TO RELATED APPLICATION

This application claims priority to U.S. Provisional Patent Application Ser. No. 61/109,778, entitled "Infant Support Structure With A Collapsible Frame," filed Oct. 30, 2008, the disclosure of which is incorporated herein by reference in its entirety.

FIELD OF THE INVENTION

The present invention relates to an infant support structure and in particular, to an infant support structure with a collapsible frame. The present invention relates to a frame for an infant support structure that includes a coupling or lock mechanism that is configured to maintain the collapsible frame in a deployed or use configuration.

BACKGROUND OF THE INVENTION

Conventional infant support structures include a frame. Some examples of such infant support structures include, but are not limited to, bouncers, swings, infant seats, and high chairs. Often the frame of an infant support structure is collapsible or foldable.

There is a need for an infant support structure that includes a frame that has a mechanism that maintains the frame in a deployed or use configuration and that is easy to manipulate by a user or caregiver to collapse or fold the frame.

SUMMARY OF THE INVENTION

In one embodiment, the present invention relates to a collapsible frame for an infant support structure. The collapsible frame can be positioned in a deployed configuration and in a collapsed configuration. In one embodiment, the collapsible frame includes a connector, a first side portion, the first side portion being coupled to the connector, a second side portion, the second side portion being movably coupled to the connector, and a coupling portion. The coupling portion is movably coupled to the first side portion and detachably coupled to the second side portion. In addition, the coupling portion can be placed in a first position and in a second position. In its first position, the coupling portion is coupled to the first side portion and the second side portion and configured to retain the frame in its deployed configuration. In its second position, the coupling portion is decoupled from the second side portion and configured to allow the frame to move from its collapsed configuration to its deployed configuration.

In one embodiment, the first side portion includes an upper portion and a lower portion. The upper portion of the first side portion is coupled to the connector and the second side portion includes an upper portion and a lower portion, and the upper portion of the second side portion is coupled to the connector. The coupling portion of the infant support structure is coupled to the lower portion of the first side portion and detachably coupled to the lower portion of the second side portion. In one implementation, the first side portion of the infant support structure includes a first coupler coupled to the lower portion of the first side portion, the second side portion includes a second coupler coupled to the lower portion of the second side portion, and the coupling portion is pivotally coupled to the first coupler and detachably coupled to the second coupler.

In addition, the coupling portion of the collapsible frame includes a locking mechanism that is configured to engage the second coupler to couple the coupling portion to the second coupler. In one implementation, the lower portion of the first side portion, the lower portion of the second side portion, and the coupling portion are disposed within the same plane. In one embodiment of the collapsible frame according to the present invention, the second side portion is pivotally coupled to the connector and the first side portion is fixedly coupled to the connector.

Alternatively, the first side portion of the collapsible frame includes a distal end and the second side portion includes a distal end. In this case, the coupling portion is coupleable to the distal end of the first side portion and to the distal end of the second side portion. The first side portion includes a tubular member and a coupler detachably coupled to the tubular member. Similarly, the second side portion includes a tubular member and a coupler detachably coupled to the tubular member. The coupling portion may be coupleable to the first side portion coupler and to the second side portion coupler.

In an alternative embodiment according to the present invention, the infant support structure includes a frame, the frame being positionable in a deployed configuration and in a collapsed configuration. The frame may include an upper portion and a lower portion. The lower portion of the frame may be reconfigurable between a first configuration and a second configuration. The frame is in its deployed configuration when the lower portion is in its first configuration and the frame is movable from its deployed configuration to its collapsed configuration when the lower portion is in its second configuration. The frame also includes a support portion, the support portion being coupled to the upper portion of the frame and configured to receive an infant therein.

In one embodiment, the lower portion of the frame is disposed within a plane and the reconfiguration of the lower portion of the frame from its first configuration to its second configuration occurs within the plane. In addition, the lower portion of the frame includes a first side portion, a second side portion, and a coupling portion, and the coupling portion is configured to be disposed between and connected to the first side portion and the second side portion. Moreover, the coupling portion is positionable in a first position and in a second portion. As a result, the frame is retained in its deployed configuration when the coupling portion is disposed in its first position, and the frame is movable from its deployed configuration to its collapsed configuration when the coupling portion is disposed in its second position.

In one implementation, the first side portion of the frame includes an elongate member and a housing coupled to the elongate member, and the second side portion includes its own elongate member and housing. The coupling portion of the frame is movably coupled to the housing of the first side portion, and the coupling portion is detachably coupled to the housing of the second side portion. The coupling portion may include a locking mechanism, and the housing of the second side portion is configured to receive a portion of the locking mechanism to secure the coupling portion to the second side portion. Alternatively, the lower portion includes a first distal end, a second distal end, and a locking member. The locking member may be coupleable to the first distal end and to the second distal end. In addition, the locking member is detachably coupled to the first distal end and to the second distal end.

In an alternative embodiment, the infant support structure includes a support portion that is configured to receive an infant. The infant support structure also includes a collapsible frame that is configured to movably support the support portion. The frame is positionable in a deployed configuration and in a collapsed configuration. The frame includes a first portion, a second portion, and a locking portion. The second portion is movable relative to the first portion, and the first portion and the second portion are spaced apart from each other when the frame is in its deployed configuration and are proximate to each other when the frame is in its collapsed configuration. The locking is coupleable to the first portion and to the second portion, and is disposed between the first portion and the second portion to maintain the frame in its deployed configuration. The frame is movable to its collapsed configuration when the locking portion is decoupled from the second portion.

In one embodiment, the frame includes a hub. The first portion of the frame is fixedly coupled to the hub, and the second portion of the frame is pivotally coupled to the hub. The locking portion is movably coupled to the first portion and detachably coupled to the second portion. The locking portion has a first end and an opposite second end. The first end of the locking portion is movably coupled to the first portion, and the second end of the locking portion is detachably coupled to the second portion. In one implementation, the first portion includes a distal end and the second portion includes a distal end. The locking portion can be coupled to the distal end of the first portion and to the distal end of the second portion.

BRIEF DESCRIPTION OF THE DRAWINGS

Like reference numerals have been used to identify like elements throughout this disclosure.

DETAILED DESCRIPTION OF THE INVENTION

Figure 1:
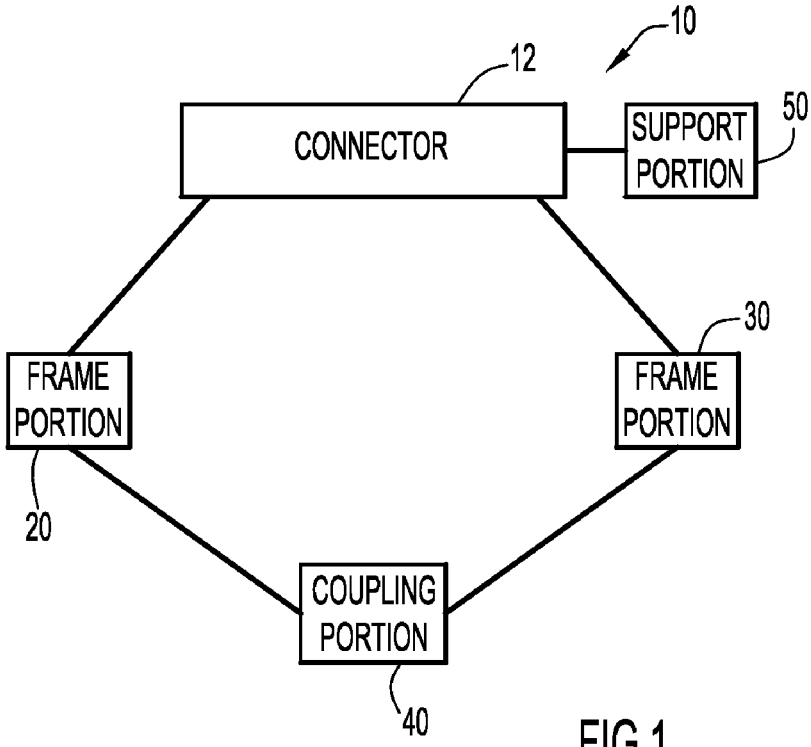
FIG. 1 is a schematic block diagram of an embodiment of an infant support structure according to the present invention.

Referring to FIG. 1, a schematic block diagram of an embodiment of an infant support structure according to the present invention is illustrated. In this embodiment, the infant support structure 10 includes frame portions 20 and 30 and a connector 12 to which the frame portions 20 and 30 are coupled. The infant support structure also includes a coupling portion 40 that can be connected to the frame portions 20 and 30. The coupling portion 40 can be used to maintain the frame portions 20 and 30 in a spaced apart or deployed configuration. The infant support structure 10 also includes a support portion 50 that is configured to receive and support an infant or child. In one embodiment, the infant support structure 10 can be an infant swing. In other embodiments, the infant support structure can be a high chair, a bouncer, or other structure that can be used to support an infant.

Figure 2:
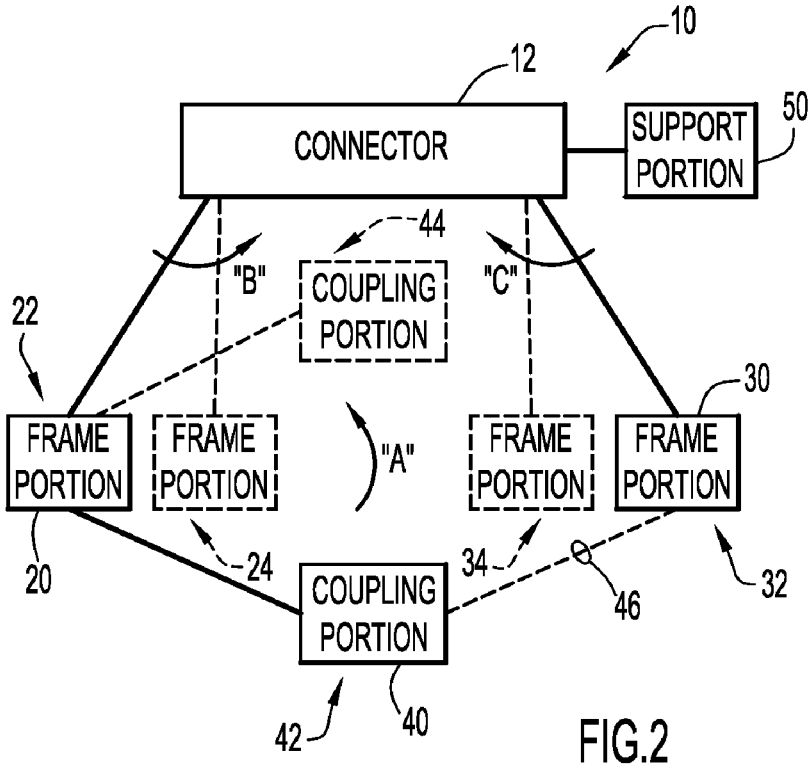
FIG. 2 is a schematic block diagram of an alternative embodiment of an infant support structure according to the present invention.

Referring to FIG. 2, some exemplary movements of the various components of the infant support structure 10 illustrated in FIG. 1 are shown. Frame portion 20 is movable between a deployed or use position 22 and a collapsed or folded position 24. Similarly, frame portion 30 is movable between a deployed or use position 32 and a collapsed or folded position 34. The coupling portion 40 is illustrated as being coupled to frame portion 20 and as detachably coupled to frame portion 30 (shown by dashed line 46).

When the coupling portion 40 is connected to frame portions 20 and 30, the coupling portion 40 keeps the frame portions 20 and 30 spaced apart and the infant support structure 10 is in a deployed configuration. When the coupling portion 40 is detached from frame portion 30, the coupling portion 40 can be moved along the direction of arrow "A" and the frame portions 20 and 30 can be moved along the directions of arrows "B" and "C," respectively, to their collapsed or folded positions 24 and 34, respectively. The coupling portion 40 can be moved to its collapsed or folded position 44 as well. When the portions 20, 30, and 40 are in their collapsed positions, the frame of the infant support structure 10 is in a collapsed configuration and the infant support structure 10 can be easily carried or transported. When a parent or caregiver wants to use the infant support structure 10, the portions 20, 30, and 40 are moved to their deployed positions 22, 32, and 42 and the infant support structure 10 can be used.

Figure 3:
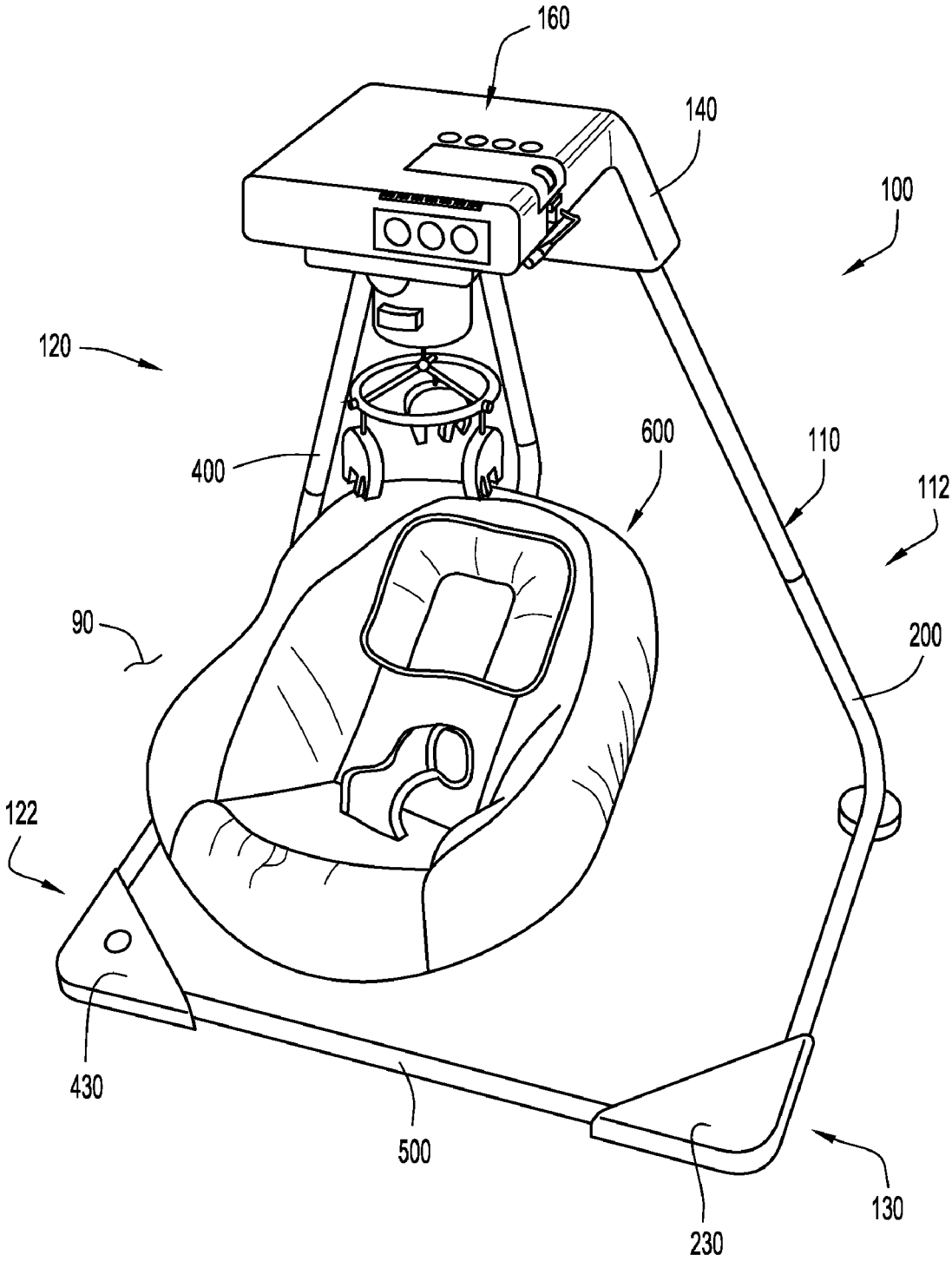
FIG. 3 is a front perspective view of an embodiment of an infant support structure according to the present invention.
Figure 4:
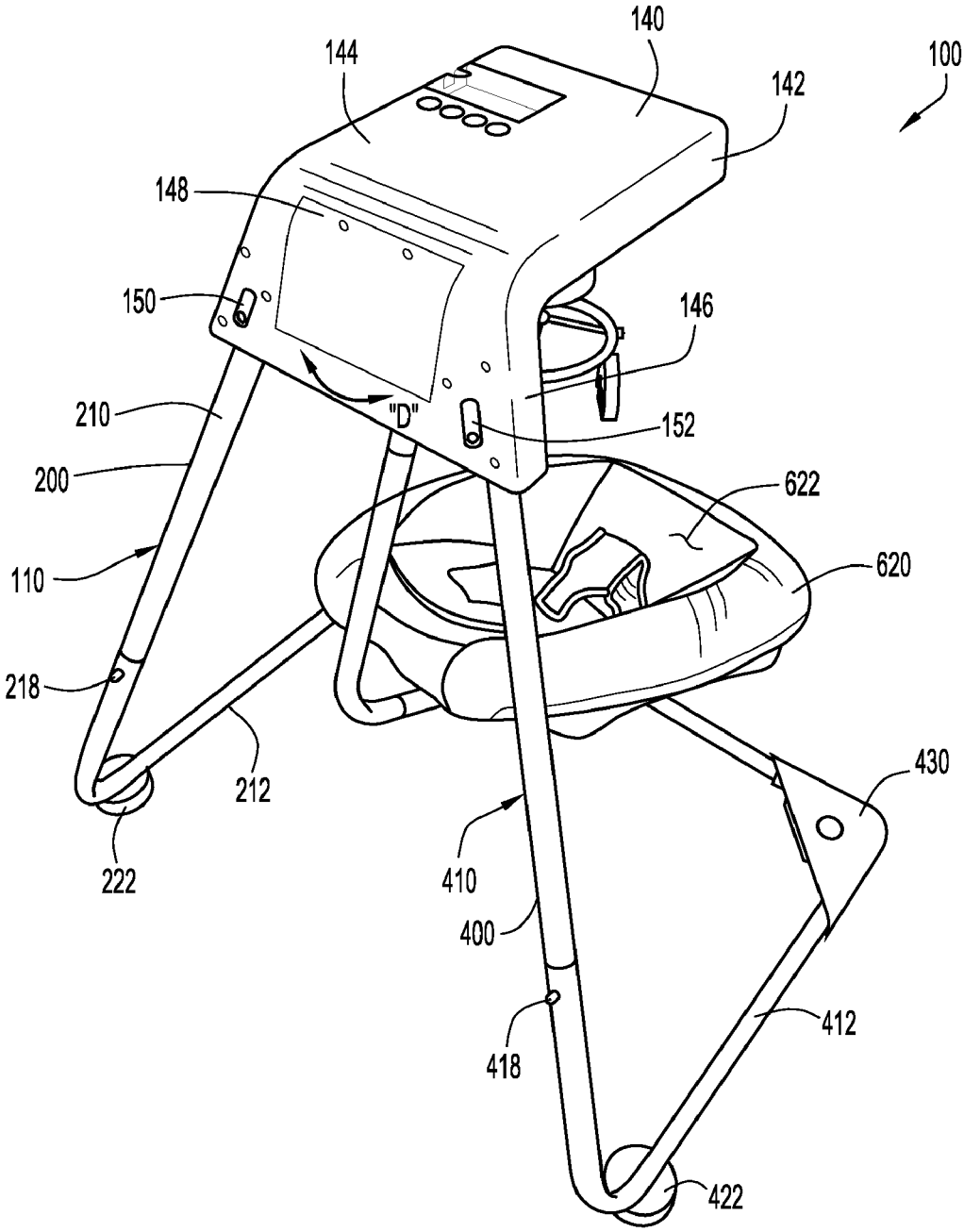
FIG. 4 is a rear perspective view of the infant support structure illustrated in FIG. 3.
Figure 5:
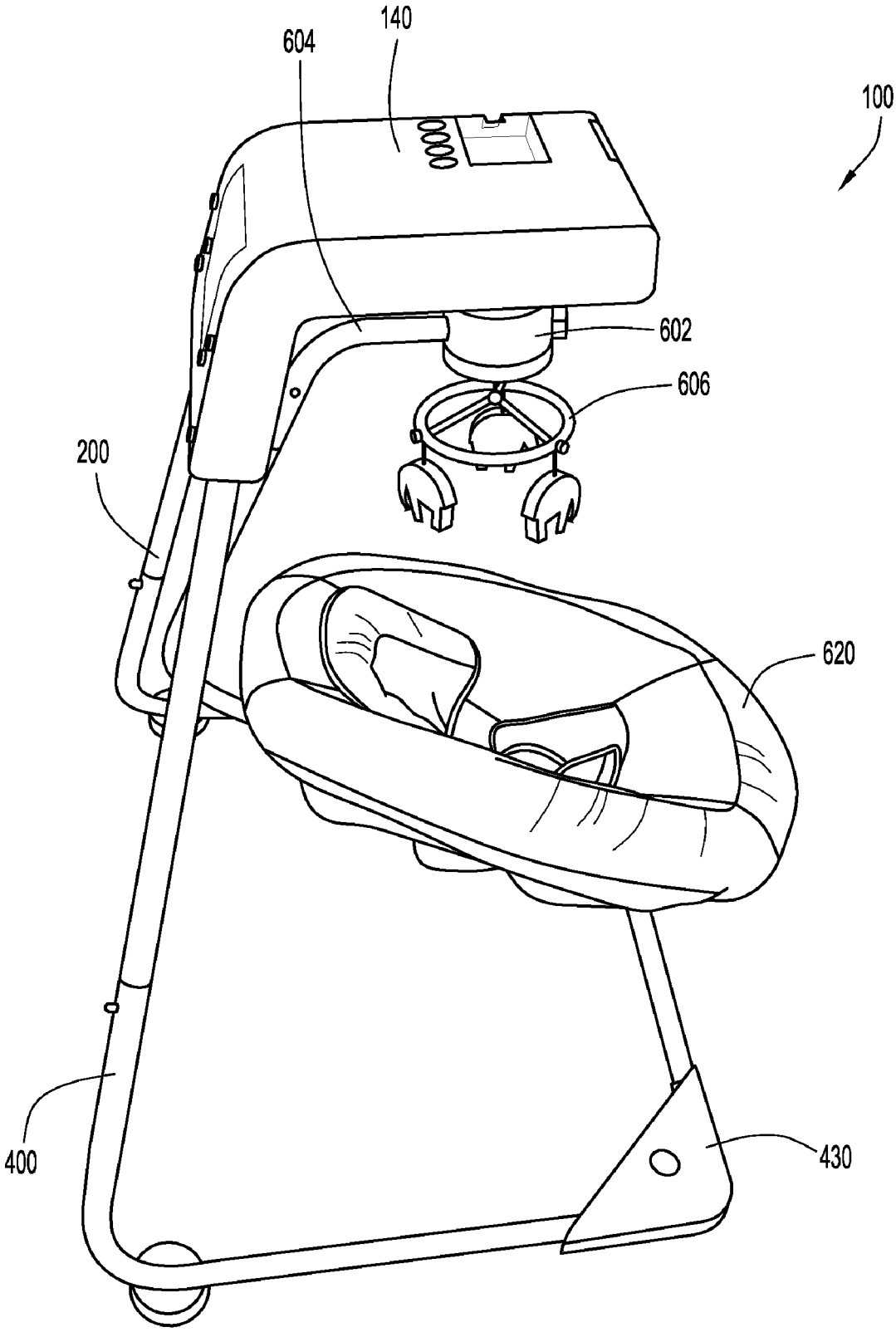
FIG. 5 is a side view of the infant support structure illustrated in FIG. 3.

Referring to FIGS. 3-5, an embodiment of an infant support structure according to the present invention is illustrated. In this embodiment, the infant support structure 100 includes a frame 110 that has a support portion 600 that is configured to receive and support an infant. The frame 110 is positionable in a deployed or use configuration 112 as shown in FIG. 3. The frame 110 has an upper portion 120 and a lower portion 122 that is configured to be placed on a support surface 90. The lower portion 122 is reconfigurable or repositionable in multiple configurations. In FIG. 3, the lower portion 122 is its deployed or use configuration 130.

The infant support structure 100 also includes a hub or connector 140 to which the support portion 600 is mounted. The hub or connector 140 includes an entertainment and control portion 160 and can be referred to as a housing as well.

The frame 110 includes side frame portions 200 and 400. The side frame portions can be referred to alternatively as side portions or frame portions. Each of the side frame portions 200 and 400 is pivotally coupled to the hub or connector 140. In an alternative embodiment, only one of the side frame portions 200 and 400 is pivotally coupled to the hub or connector 140. As shown in FIG. 3, side frame portion 200 includes a coupler and housing 230 coupled to the distal or front end of the side frame portion 200. Similarly, side frame portion 400 includes a coupler and housing 430 coupled to the distal or front end of the side frame portion 400.

The frame 110 also includes a coupling portion 500 that is connected to the couplers 230 and 430. The coupling portion 500 can be referred to alternatively as an end frame portion, front frame portion, or lock or locking portion. In this embodiment, as described in detail below, the coupling portion 500 is movably coupled to coupler 230 and is detachably coupled to coupler 430. In other words, coupling portion 500 can be placed between and coupled to each of the couplers 230 and 430 and as a result, to each of the side frame portions 200 and 400. When a parent or caregiver wants to collapse the frame 110, the coupling portion 500 is detached or decoupled from coupler 430 and moved relative to coupler 230, thereby allowing one or both of the side frame portions 200 and 400 to be moved toward each other.

Referring to FIG. 4, a rear perspective view of the infant support structure 100 is illustrated. As shown, the hub 140 includes a body 142 with an upper portion 144 and a lower portion 146. In different embodiments, the size and configuration of the hub 140 may vary. The hub 140 includes a battery compartment in which a power source, such as one or more batteries, may be placed. In addition, the hub 140 include release mechanisms 150 and 152, which can be movably mounted buttons, that are positioned to engage stop or valco buttons coupled to side frame portions 200 and 400, respectively. When a user presses on the release mechanisms 150 and 152, the side frame portions 200 and 400 are unlocked from their fixed positions and can be pivoted relative to the hub 140.

The support portion 600 includes a seat 620 that has a receiving area 622 in which an infant or child can be placed. The seat 620 is coupled to the hub 140 for reciprocating movement along the directions of arrow "D."

Side frame portion 200 of frame 110 includes an upper portion 210 and a lower or ground engaging portion 212. The upper portion 210 and lower portion 212 are tubular members that can be coupled to each other by a coupling mechanism 218, such as spring button, that is mounted in one of the portions 210 or 212 and engages a corresponding opening in the other portion 212 or 210. The lower portion 212 includes a contact or engagement member 222 that is coupled to the lower portion 210 and that provides stability to the frame 110.

Similarly, side frame portion 400 includes an upper portion 410 and a lower or ground engaging portion 412. The upper portion 410 and lower portion 412 are tubular members that can be coupled to each other by a coupling mechanism 418, such as a spring button, that is mounted one of the portions 410 or 412 and engages a corresponding opening in the other portion 412 or 410. The lower portion 412 includes a contact or engagement member 422 that is coupled to the lower portion 410 and that provides stability to the frame 110. The coupler or housing 430 is coupled to the distal or front end of the lower portion 412.

Referring to FIG. 5, a side view of the infant support structure 100 is illustrated. As shown, a hub 602 is pivotally mounted to the connector 140. A swing arm 604 is mounted to the hub 602 and the seat 620. In one embodiment, a mobile 606 may be coupled to the hub 602 above the seat 620.

Figure 6:
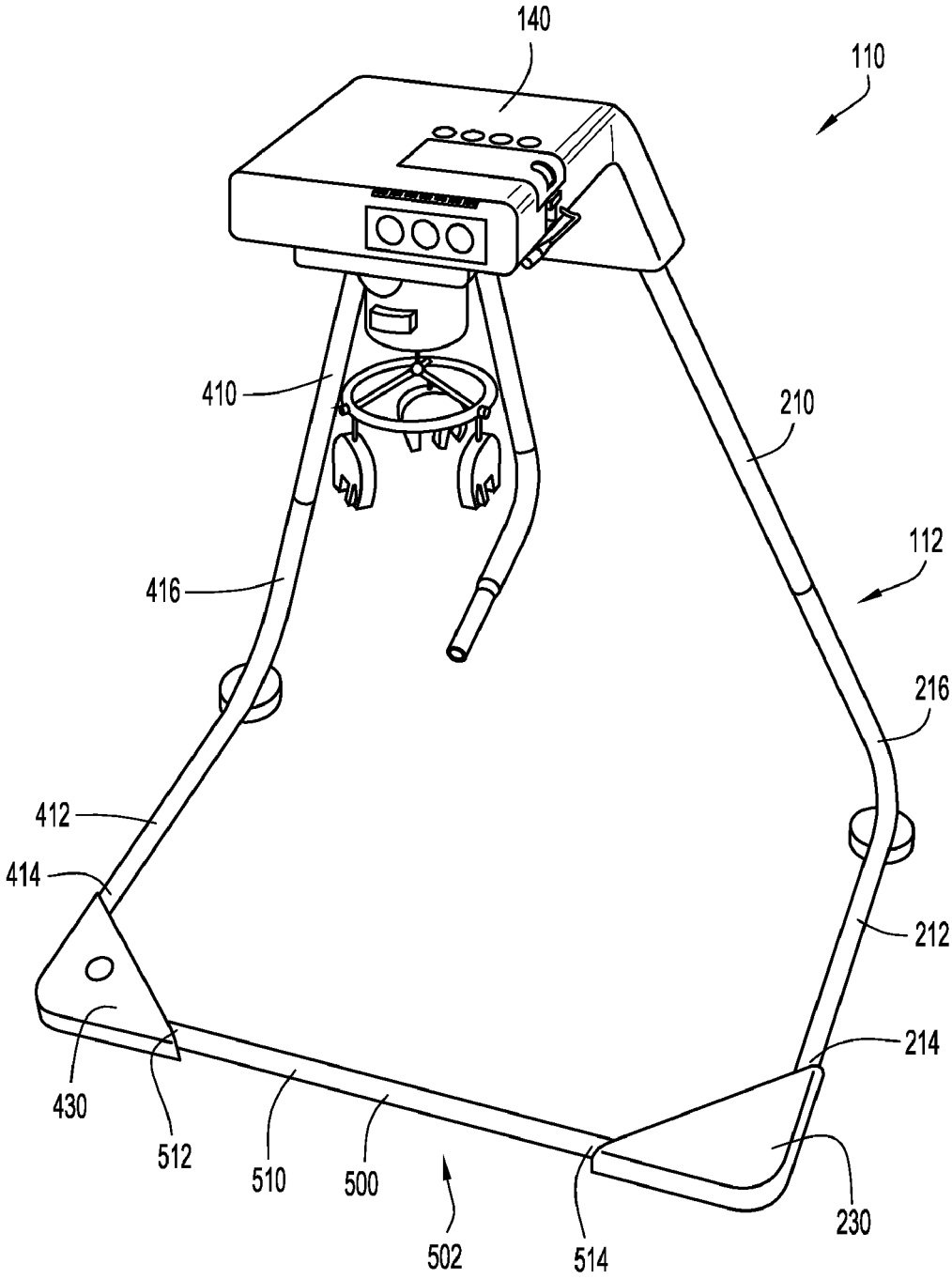
FIG. 6 is a front perspective view of the frame of the infant support structure illustrated in FIG. 3 with the support portion removed.
Figure 7:
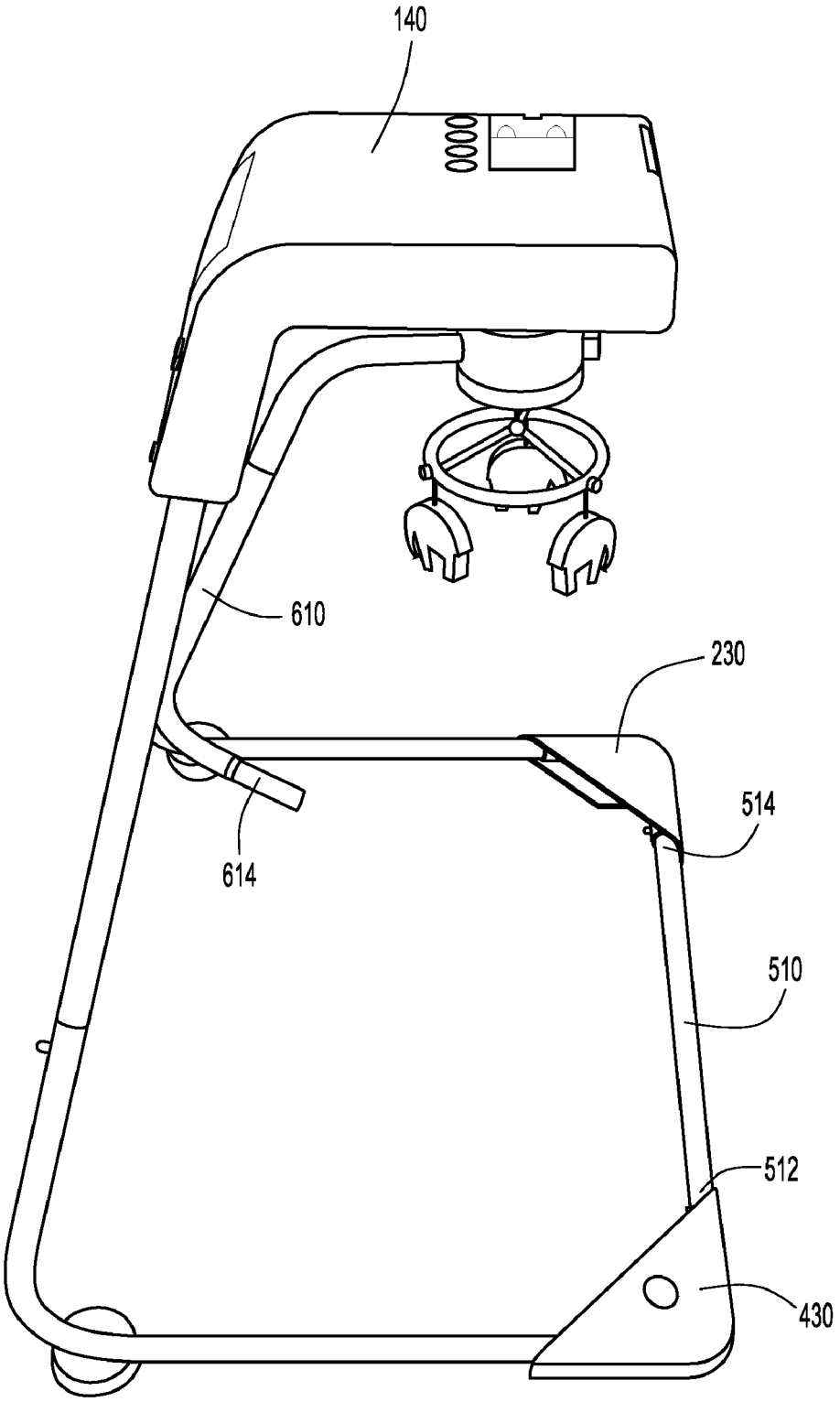
FIG. 7 is a side view of the frame illustrated in FIG. 6.

Referring to FIGS. 6 and 7, the frame 110 of infant support structure 100 is illustrated in its deployed or use configuration 112 with the seat 620 removed for ease of reference. As shown, the upper portion 210 of side frame portion 200 is coupled to the hub 140 and to the lower portion 212. The lower portion 212 has a distal or front end 214 that is connected to coupler 230 and a rear end 216 that is coupled to the upper tubular member 210. Similarly, the upper portion 410 of side frame portion 400 is coupled to the hub 140 and to lower portion 412. The lower portion 412 has a distal or front end 414 that is connected to coupler 430 and a rear end 416 that is coupled to the upper tubular member 410. As shown in FIG. 7, the frame 110 includes a hanger arm 610 with a lower end 614 to which the seat 620 is coupled.

As mentioned above, the frame 110 includes a coupling or lock portion 500 that includes an elongate body or member 510 with ends 512 and 514. In FIG. 6, the coupling portion 500 is illustrated in its deployed or use position 502. In this position, the coupling portion 500 is between the side frame portions 200 and 400, thereby maintaining the frame 110 in its deployed configuration 112 for use.

Figure 8:
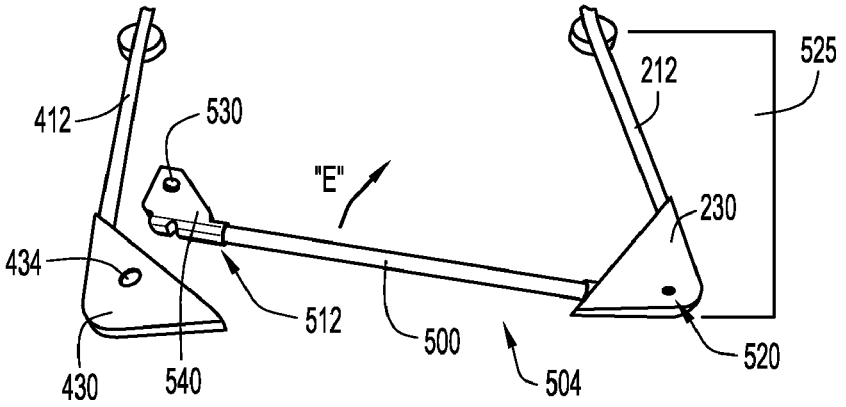
FIGS. 8-10 are front views of the lower portion of the frame in unlocked configurations.
Figure 9:
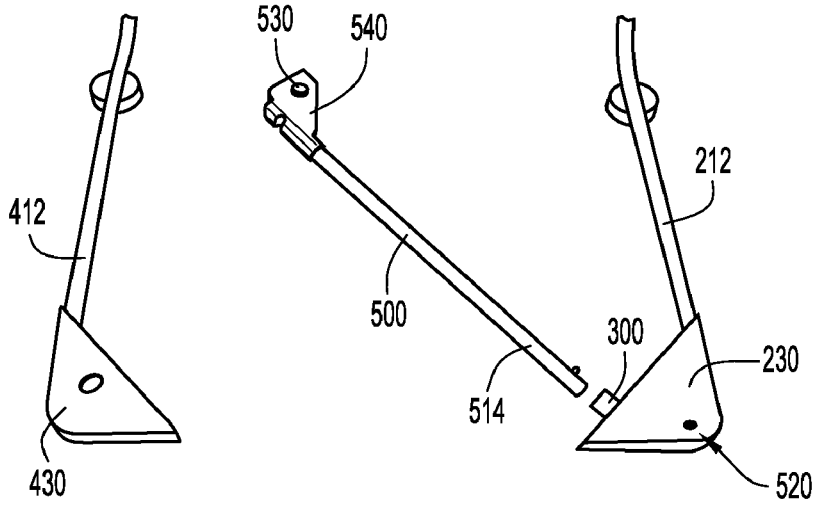
Figure 10:
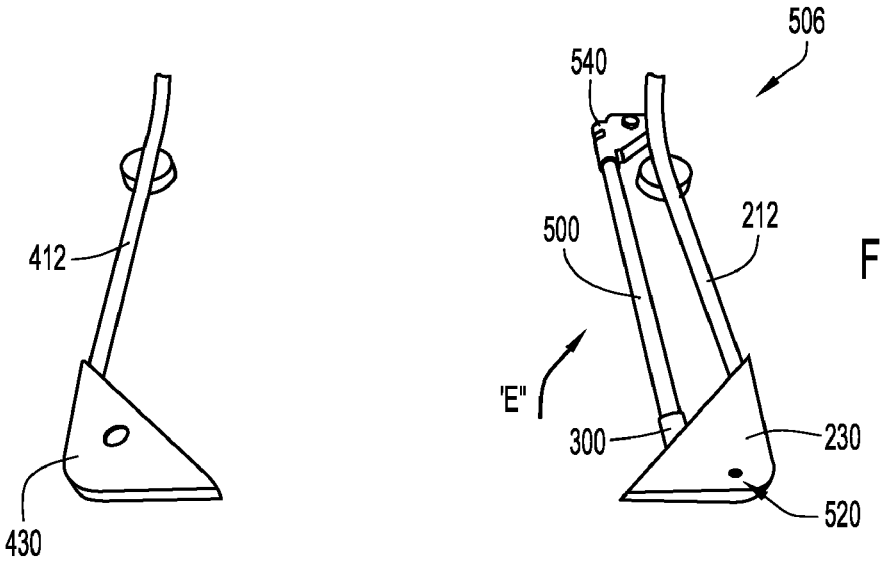

Referring to FIGS. 8-10, the movement of the coupling portion 500 is illustrated. Only the lower portions 212 and 412 of the side frame portions 200 and 400 are illustrated for ease of reference. In FIG. 8, the coupler 430 attached to lower portion 412 includes an opening 434 formed therein. The lower portions 212 and 412 and the coupling portion 500 are located in substantially the same plane 525. As the coupling portion 510 moves along the direction of arrow "E" from its unlocked position 504 shown in FIG. 8 to its folded position 506 shown in FIG. 10, the coupling portion 510 moves within plane 525.

As shown in FIG. 8, a housing 540 is coupled to end 512 of coupling portion 500. The function and features of housing 540 are described in detail below. The opening 434 in coupler 430 is engaged by a depressible button 530 that is on housing 540 when the housing 540 is positioned proximate to the coupler 430. When the button 530 is pressed downwardly and disengaged from the opening 434, the coupling portion 500, which is coupled to coupler 230, can be moved or rotated about axis 520 along the direction of arrow "E."

Referring to FIG. 9, the coupling portion 510 is shown detached from the coupler 230 for ease of reference only. Coupling portion 510 has an end 514 that is slidably connected to rotating member 300 which is pivotally connected to the body of the coupler 230. In FIG. 10, the end 514 is connected to rotating member 530.

Figure 11:
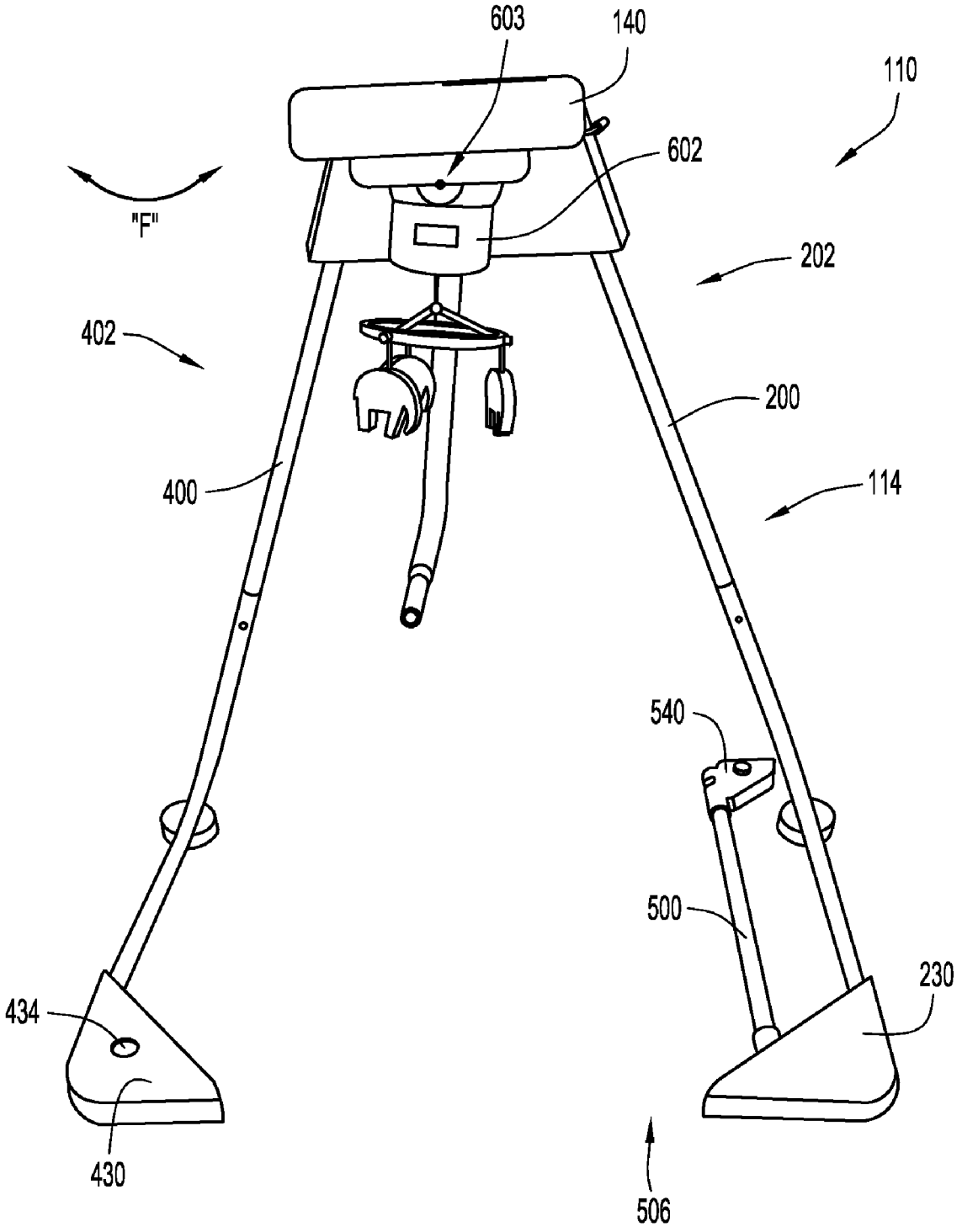
FIG. 11 is a front view of the frame illustrated in FIG. 6 in an unlocked configuration.
Figure 12:
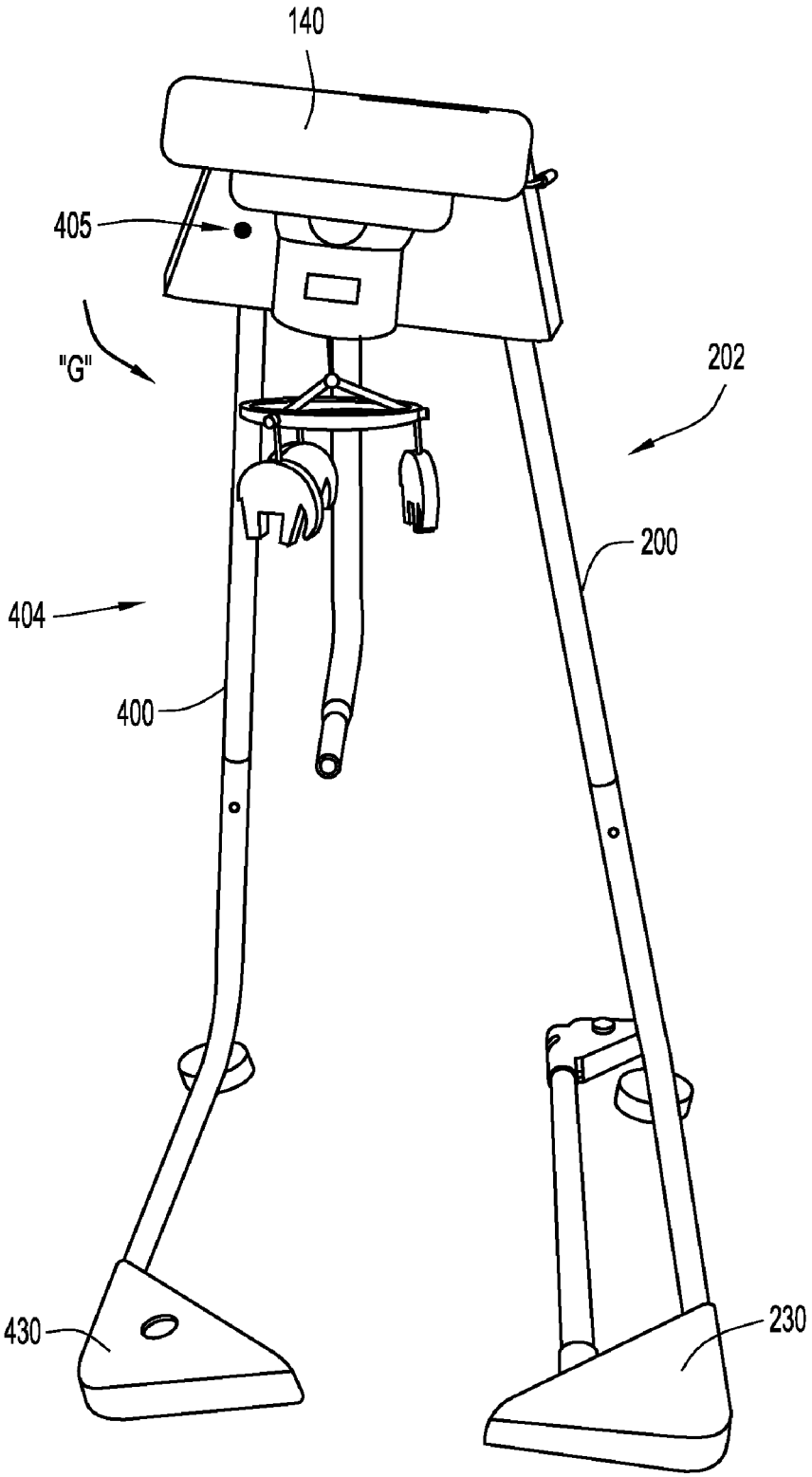
FIG. 12 is a front view of the frame illustrated in FIG. 6 in a partially collapsed configuration.
Figure 13:
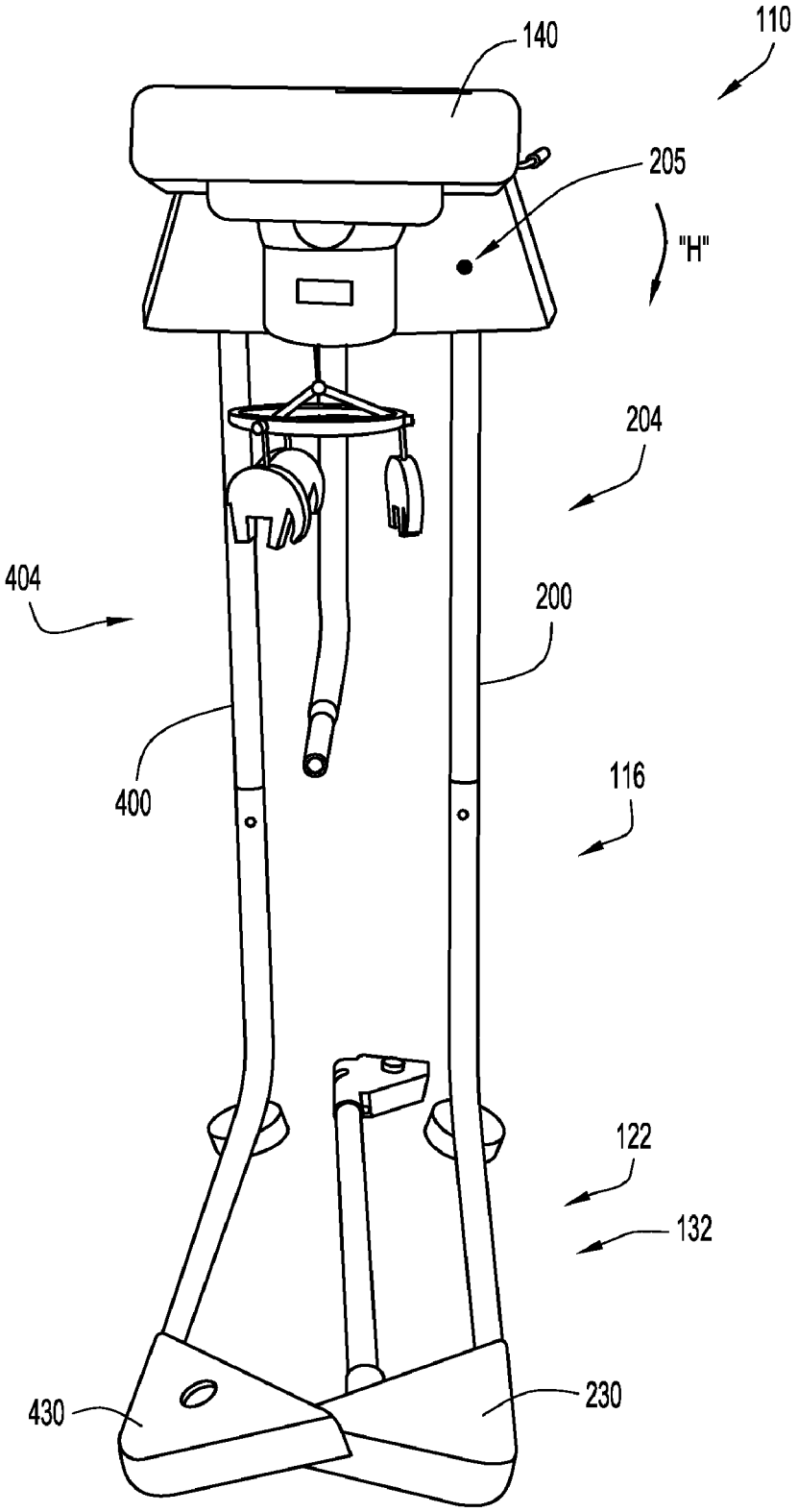
FIG. 13 is a front view of the frame illustrated in FIG. 6 in a fully collapsed configuration.

Referring to FIGS. 11-13, an exemplary manner of collapsing the frame 110 of the infant support structure 100 is illustrated. In FIG. 11, a front view of several of the components of the frame 110 is shown. Side frame portions 200 and 400 with corresponding couplers 230 and 430 are illustrated coupled at their upper ends to the hub 140. The swing hub 602 is mounted to hub 140 for movement about axis 603 along the directions of arrow "F."

In FIG. 11, side frame portion 200 is illustrated in its deployed position 202 and side frame portion 400 is illustrated in its deployed position 402. However, the frame 110 is placed in its unlocked configuration 114 in which the coupling portion 500 is placed in its unlocked position 506. In this position 506, the coupling portion 500 is not positioned so as to prevent one or both of the side portions 200 and 400 to move toward the other side portion.

Referring to FIG. 12, side frame portion 400 is moved about axis 405 along the direction of arrow "G" to its collapsed position 404. During this movement, the side frame portion 400 remains coupled to the hub 140. The side frame portion 200 has not been moved from its deployed position 202. When a parent or caregiver wants to use the infant support structure 100, side frame portion 400 can be moved to its deployed position 402 along the direction opposite to that of arrow "G."

Referring to FIG. 13, the side frame portion 400 remains in its collapsed position 404 and side frame portion 200 is moved about axis 205 along the direction of arrow "H" to its collapsed position 204. Like portion 400, during this movement, side frame portion 200 remains coupled to the hub 140. In FIG. 13, the frame 110 is positioned in its collapsed configuration 116. In this configuration the lower portion 122 has been reconfigured and it is in a closed or collapsed configuration 132 as well. When the infant support structure 100 is to be used, side frame portion 200 can be moved to its deployed position 202 along the direction opposite to that of arrow "H."

Figure 14:
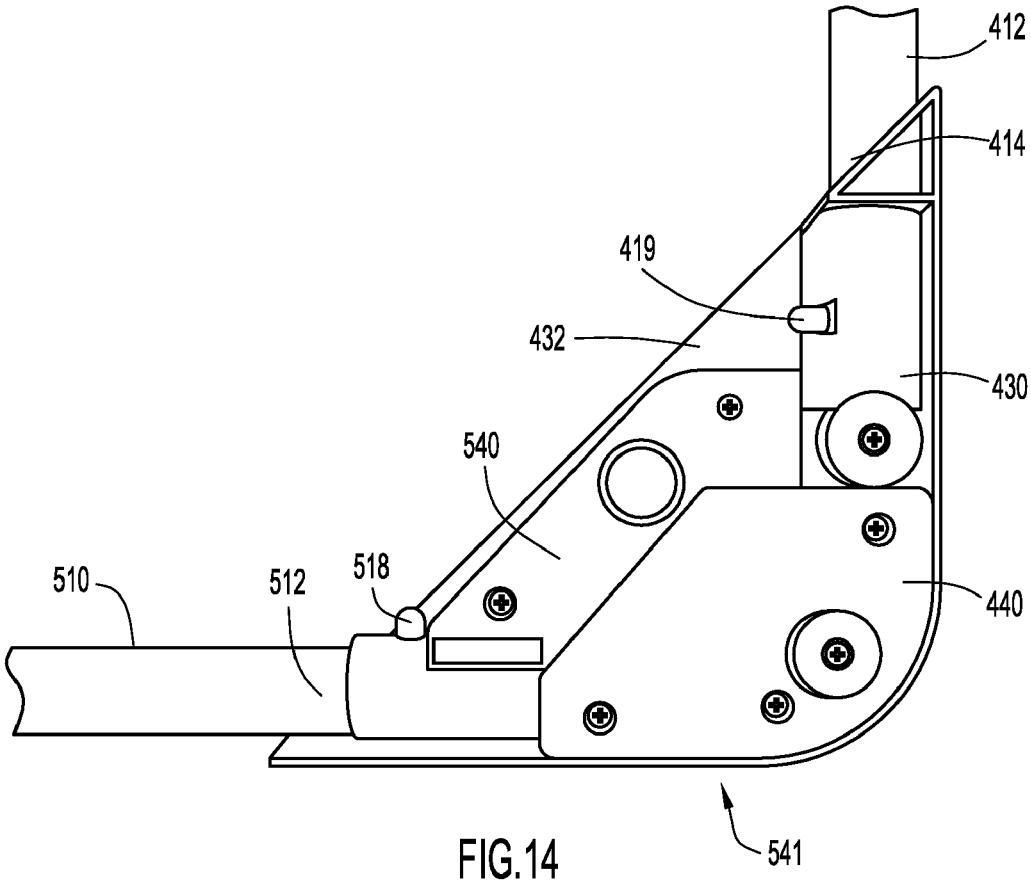
FIG. 14 is a bottom view of a coupler of the infant support structure illustrated in FIG. 3.

Referring to FIG. 14, a bottom view of coupler 430 is illustrated. In this embodiment, coupler 430 is configured to receive end 414 of lower portion 412. A coupling mechanism 419, such as a spring button, is used to detachably connect the lower portion 412 to the coupler 430. The coupler 430 includes a plate 440 coupled thereto using fasteners, such as screws. The plate 440 defines a receptacle with upper portion 432 to receive housing 540 therein.

As shown, housing 540 is coupled to body 510 of coupling portion 500. In particular, end 512 is inserted into the housing 540 and coupled thereto by a coupling mechanism 518, such as a spring button. When the housing 540 is inserted into the coupler 430, it is placed in position 541.

Figure 15:
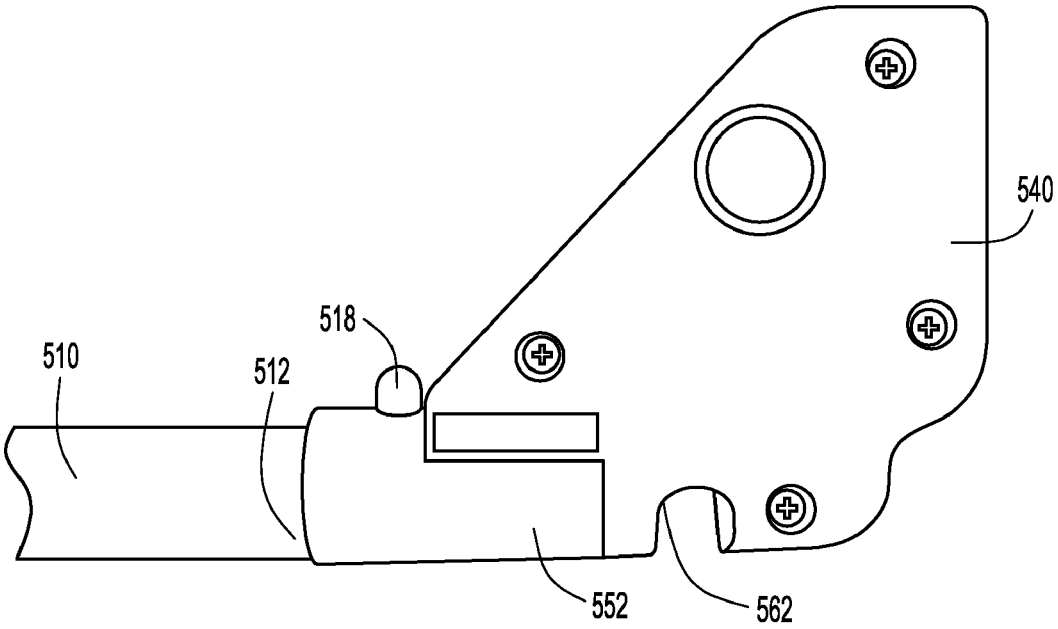
FIG. 15 is a bottom view of a housing of the infant support structure illustrated in FIG. 3.

Referring to FIG. 15, a bottom view of the housing 540 is illustrated. In this embodiment, the housing 540 includes a notch 562 along one side. The housing 540 also includes a sleeve 552 that is configured to receive the end 512 of body 510. Coupling mechanism 518 is shown as engaging the sleeve 552. When a user wants to separate the body 510 from the housing 540, the user presses inwardly on the coupling mechanism 518 and when the mechanism 518 moves a sufficient distance, the body 510 can be pulled out of the sleeve 552.

Figure 16:
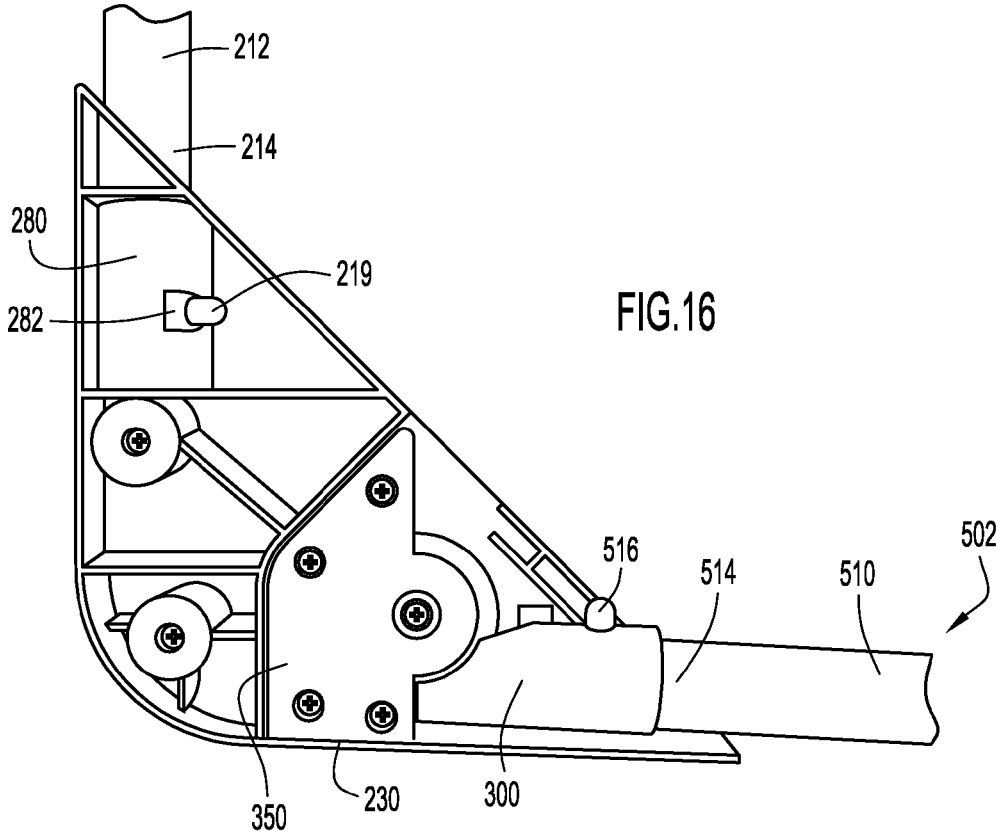
FIG. 16 is a bottom view of another coupler of the infant support structure illustrated in FIG. 3 in a deployed configuration.
Figure 17:
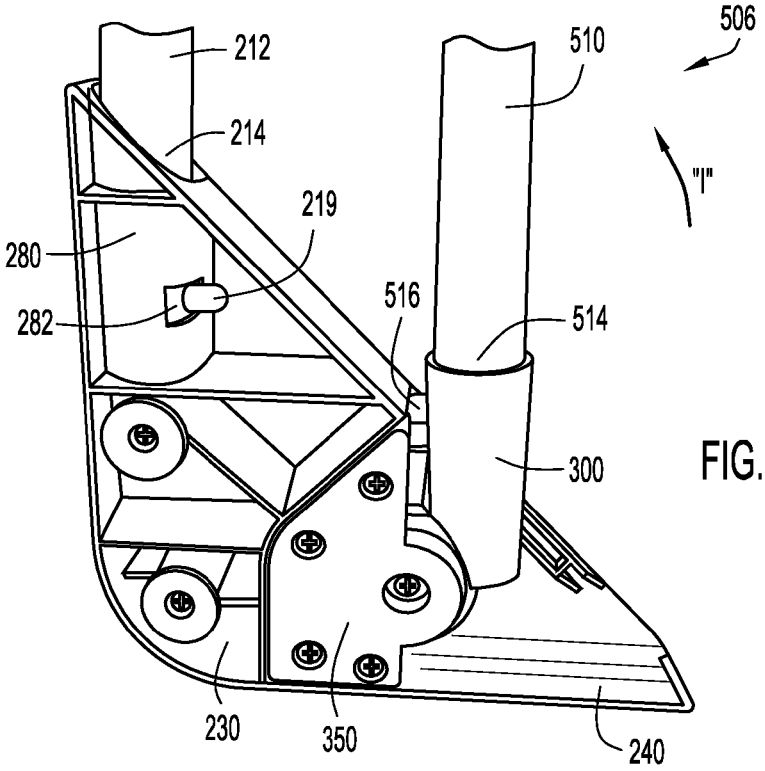
FIG. 17 is a bottom view of the coupler illustrated in FIG. 16 in a folded configuration.

Referring to FIGS. 16 and 17, bottom views of coupler 230 are illustrated. In this embodiment, end 214 of lower portion 212 is connected to coupler 230. In particular, end 214 is inserted into a receptacle formed by sleeve 280. The sleeve 280 includes an opening 282 into which a coupling mechanism 219, such as a spring button, can be inserted to connect the lower portion 212 to the coupler 230.

The coupler 230 also includes a rotating member or portion 300 that is pivotally or rotatably mounted to the coupler 230. A mount or mounting component 350 is fastened to the body 240 of the coupler 230 by fasteners, such as screws. The mount 350 is positioned to capture can secure the rotating member 300 between the mount 350 and the body 240 of the coupler 230.

End 514 of the coupling portion body 510 is inserted into the rotating member 300 and secured thereto by spring button 516. The coupling portion 500 and the rotating member 300 can move from a deployed or use position 502 (see FIG. 16) to along the direction of arrow "I" to a folded position 506 (see FIG. 17). In this embodiment, the range of movement of the coupling portion body 510 is approximately 90°. In other embodiments, the range of movement can vary.

Figure 18:
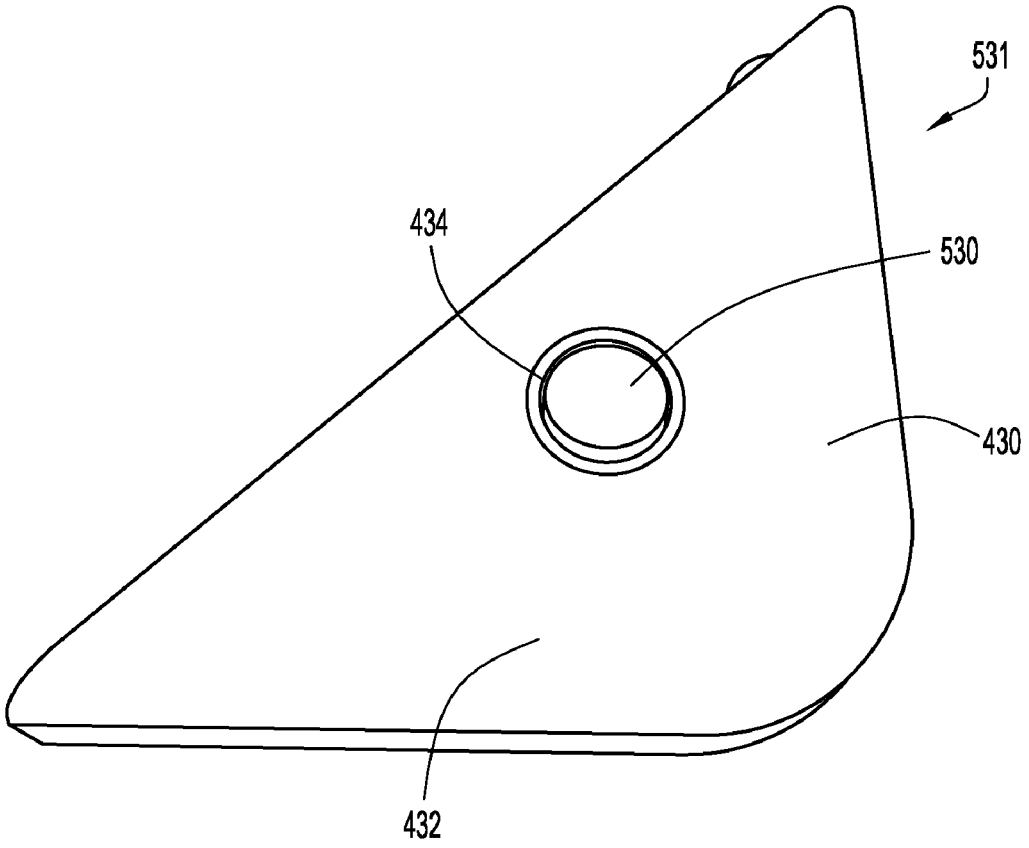
FIG. 18 is a top view of the coupler illustrated in FIG. 14.

Referring to FIG. 18, a top view of coupler 430 without the lower portion 412 or coupling portion 500 coupled thereto is illustrated. The coupler 430 includes an upper portion 432 in which an opening 434 is formed. A locking mechanism or button 530 is configured so that it can extend through the opening 434. The button 530 is coupled to the housing 540 and extends therefrom. The button 530 is biased to an extended or locking position 531 as shown in FIG. 18.

Figure 19:
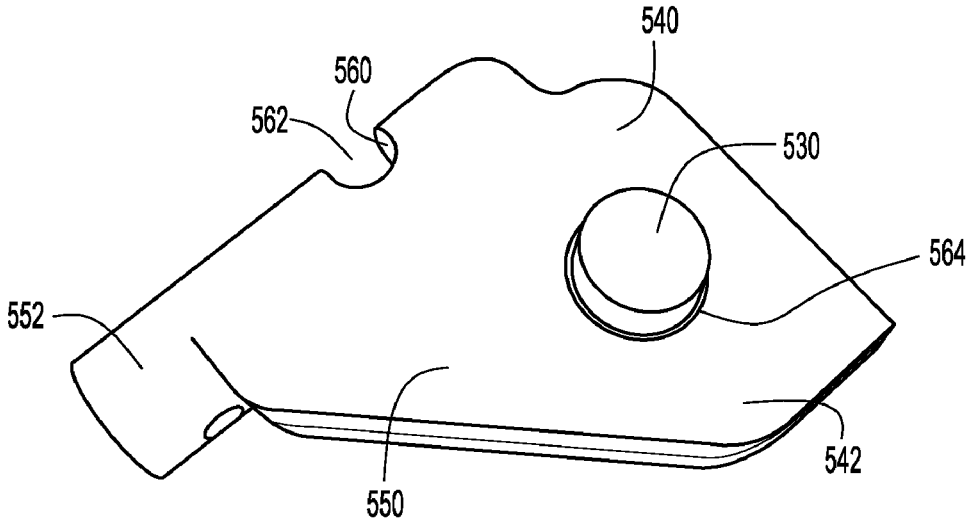
FIG. 19 is a top view of the housing illustrated in FIG. 15.
Figure 20:
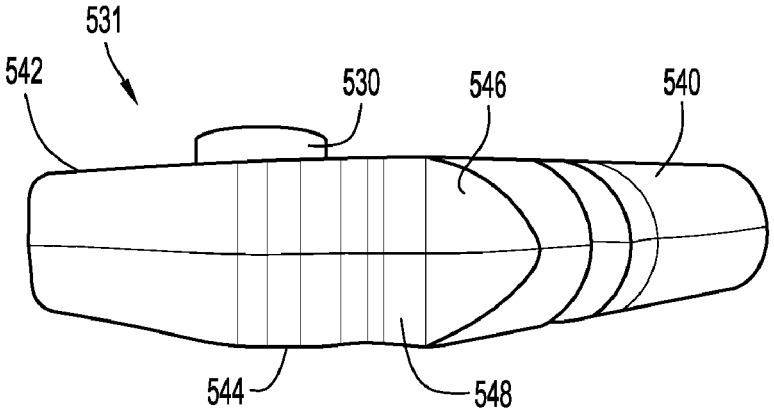
FIG. 20 is a side view of the housing illustrated in FIG. 19 in a locked configuration.
Figure 21:
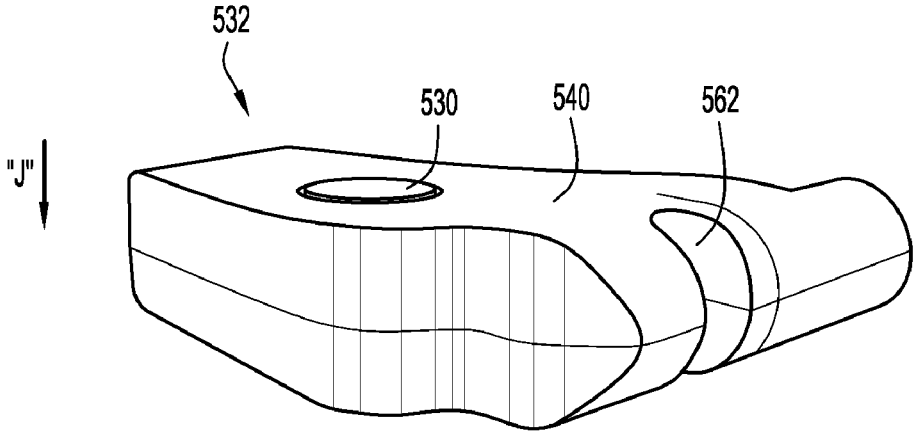
FIG. 21 is a side view of the housing illustrated in FIG. 19 in an unlocked configuration.

Referring to FIGS. 19-21, different views of housing 540 according to the present invention are illustrated. As shown, the housing 540 includes a body portion 550 with an upper surface 542 and a lower surface 544. In one embodiment, the body portion 550 may include an upper portion 546 and a lower portion 548 that can be coupled together using conventional fasteners, such as screws. The body portion 550 includes a sleeve 552 and a wall 560 that defines a notch 562 that is configured to receive a corresponding abutment on coupler 430 so ensure that the button 530 is aligned the opening 434 in the coupler 430.

The body portion 550 also includes an opening 564 in which the button 530 is movably positioned. The button 530 is movable between an extended or locked position 531 (see FIG. 20) and a depressed or retracted or unlocked position 532 (see FIG. 21). The button 530 can be pressed along the direction of arrow "J" from position 531 to position 532.

Figure 22:
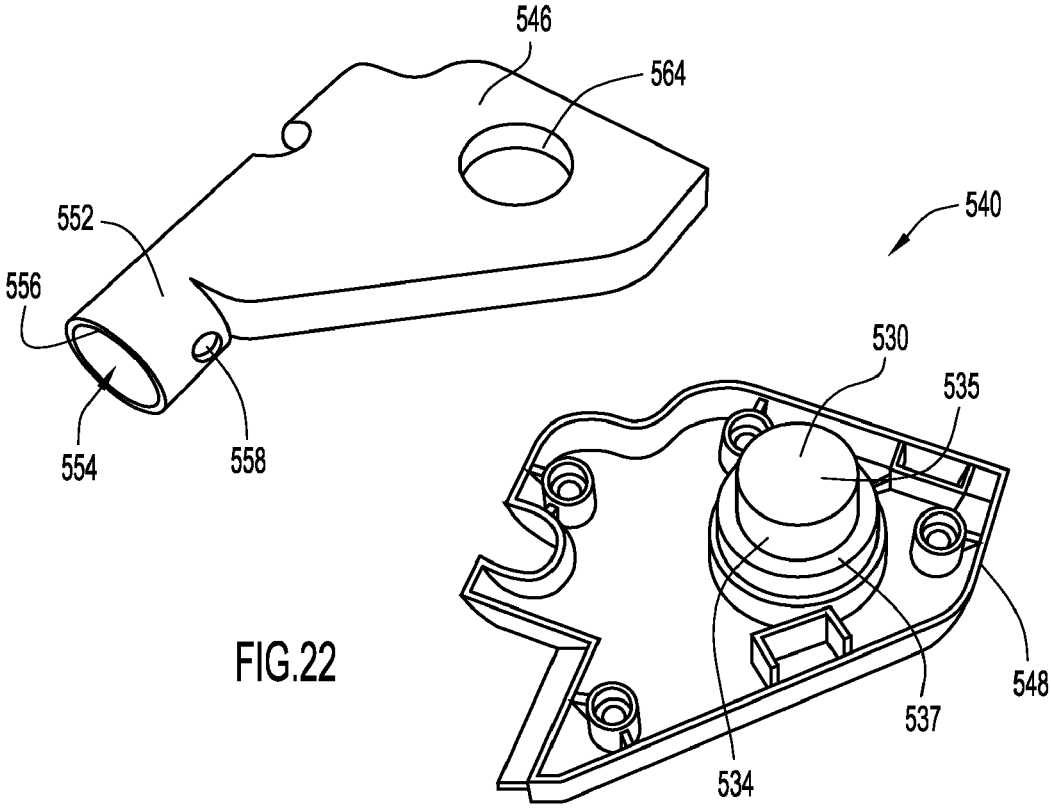
FIGS. 22 and 23 are exploded perspective views of the housing illustrated in FIG. 19.
Figure 23:
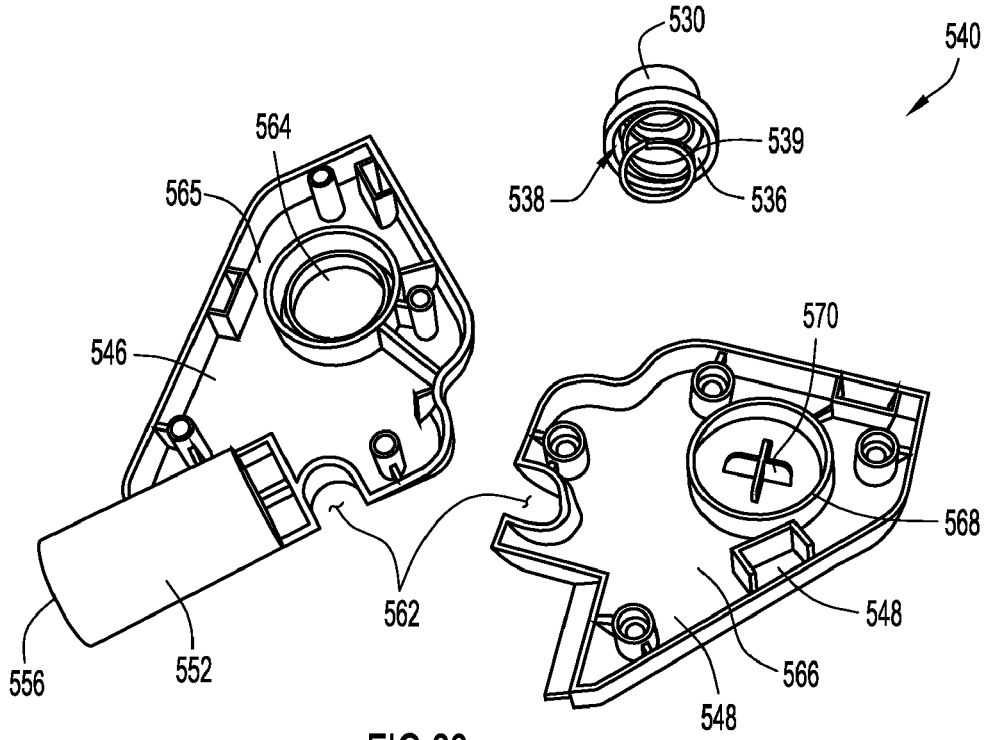

Referring to FIGS. 22 and 23, exploded views of the housing 540 are illustrated. In these illustrations, the upper portion or part 546 is separated from the lower portion or part 548. As shown in FIG. 22, the sleeve 552 of the upper part 546 includes a receptacle 554 that is open at end 556. The receptacle 554 is configured to receive an end of the coupling portion 500. The sleeve 552 may include an alignment member, such as a pin, in the receptacle 554 to mate with a slot on the coupling portion 500 to ensure alignment of the coupling portion 500 in the receptacle 554. In a side of the sleeve 552 is an opening or slot 558 that is configured to be engaged by a coupler of the coupling member 500. The upper part 546 also includes an opening 564, as previously discussed.

The button 530 is mounted on the lower part 548. In this embodiment, the button 530 includes a body 534 with a contact surface 535 and a ridge 537. The ridge 537 is configured to engage the inner or lower surface of the wall 565 defining the opening 564 in the upper part 546 (see FIG. 23), thereby limiting movement of the button 530 relative to the upper part 546. As shown in FIG. 23, the body of the button 530 includes an inner surface 536 that defines a receptacle 538 in which a biasing mechanism 539, such as a spring, is placed. The biasing mechanism 539 provides a force on the button 530 in an upward direction away from the lower part 548. When the button body 534 is pressed by a user, the biasing mechanism 539 provides a force in the opposite direction. The range of movement of the button 530 is determined in part by the length of the biasing mechanism 539.

As shown in FIG. 23, the lower portion 548 includes an inner surface 566 from which a wall or shoulder 568 extends. The wall 568 is spaced around a mount 570 on which an end of the biasing mechanism 539 is placed.

Figure 24:
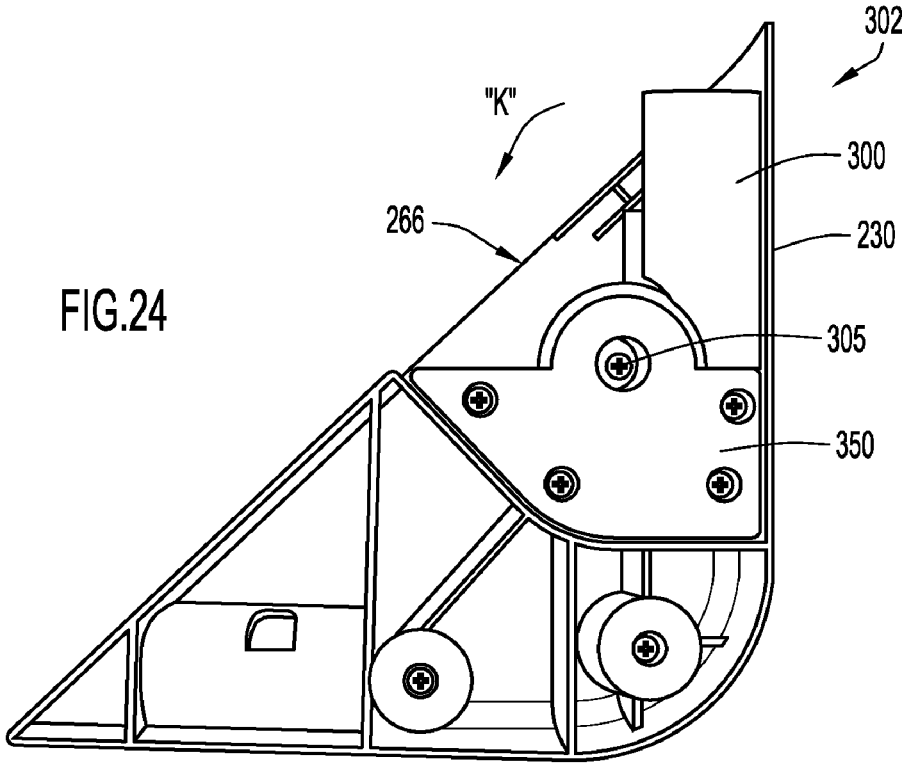
FIG. 24 is a bottom view of the coupler illustrated in FIG. 14 in a deployed configuration.
Figure 25:
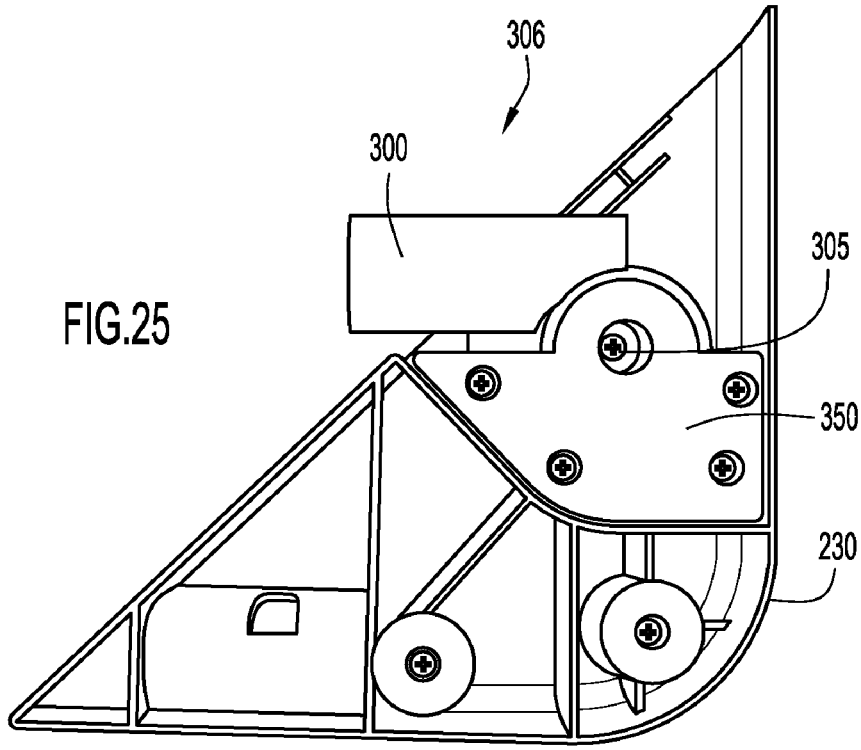
FIG. 25 is a bottom view of the coupler illustrated in FIG. 14 in a folded configuration.

Referring to FIGS. 24-28, the different configurations of the coupler 230 are illustrated. As shown in FIG. 24, the coupler 230 includes a mount 350 that is used to secure the rotating member 300 to the body of the coupler 230. The rotating member 300 is mounted for rotation about axis 305 along the direction of arrow "K." The rotating member 300 in FIG. 24 is illustrated in a deployed or use position 302. The body of the coupler 230 includes a positioner 266 integrally formed thereon, the function of which is described in detail below. In FIG. 25, the rotating member 300 has been moved about axis 305 to its collapsed or folded position 306.

Figure 26:
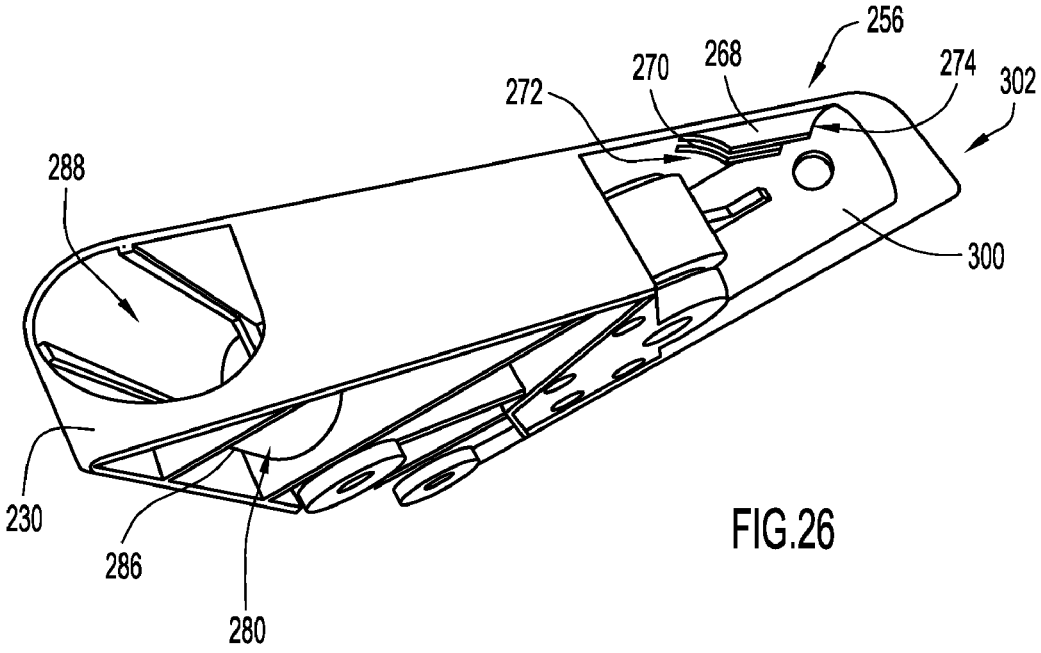
FIG. 26 is a bottom perspective view of the coupler illustrated in FIG. 14 in a deployed configuration.
Figure 27:
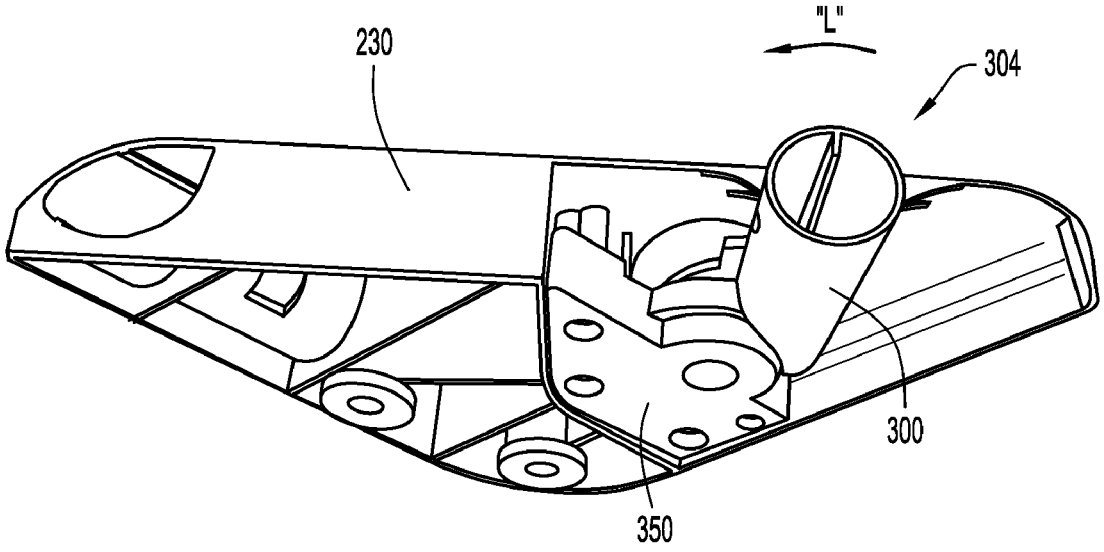
FIG. 27 is a bottom perspective view of the coupler illustrated in FIG. 14 in an intermediate configuration.
Figure 28:
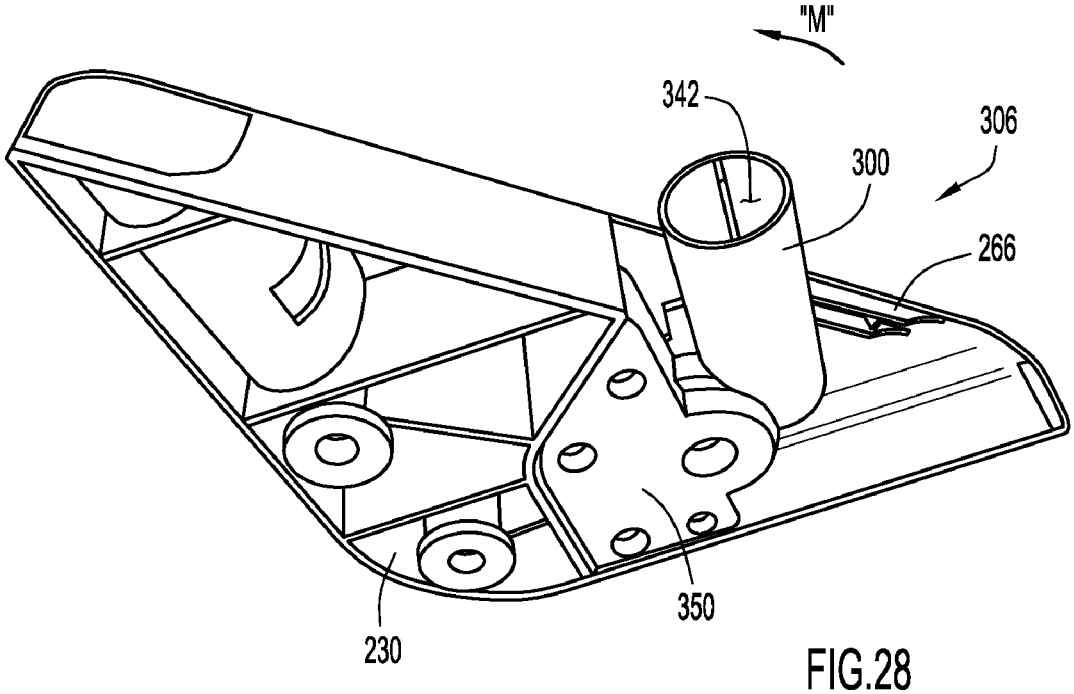
FIG. 28 is a bottom perspective view of the coupler illustrated in FIG. 14 in a folded configuration.

Referring to FIG. 26, the sleeve 280 of the coupler 230 is illustrated. In this embodiment, the sleeve 280 includes a wall 286 that defines a receptacle 288 into which lower portion 212 of the frame 110 is inserted. At the other end of the coupler 230, the rotating member 300 is placed in its deployed position 302. In one embodiment, the position 266 includes a pair of rails or ridges 268 and 270 that have sloped ends 272 and 274. The sloped ends 272 and 274 provide surfaces that the rotating member 300 can slide along as the rotating member 300 moves between positions 302 and 306. In addition, the ends 272 and 274 define the positions 302 and 306 of the rotating member 300. In FIG. 27, when the rotating member 300 is moved along the direction of arrow "L" in FIG. 27, the rotating member 300 can be positioned so that it engages and placed on the tops of the rails 268 and 286 as shown by intermediate position 304. In FIG. 28, the rotating member 300 is moved along the direction of arrow "M" to its folded position 306 by sliding along the rails 268 and 270 of the positioner 266. In FIG. 28, the receptacle 342 of the rotating member 300 is shown.

Figure 29:
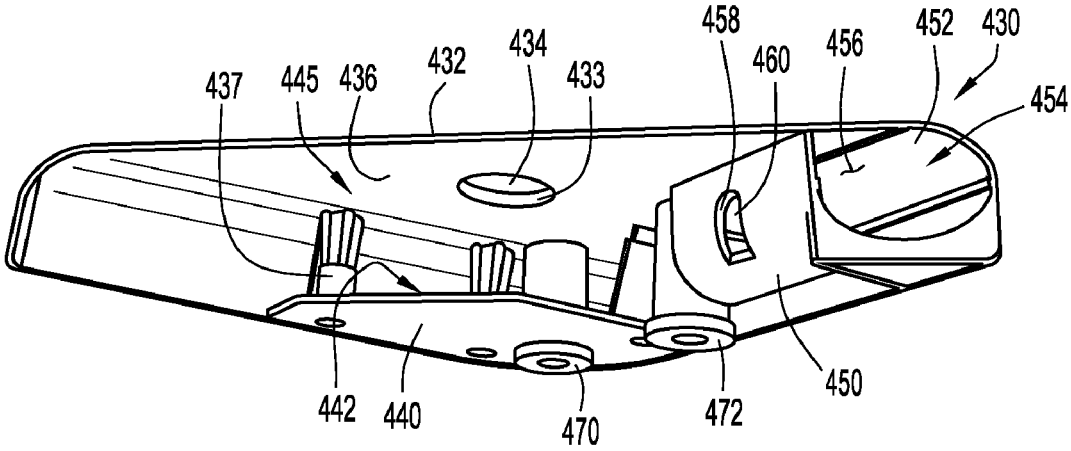
FIG. 29 is a bottom perspective view of the coupler illustrated in FIG. 18.

Turning to FIG. 29, a perspective view of coupler 430 is illustrated. The coupler 430 includes an upper portion 432 that has an edge 433 forming the opening 434 and an inner surface 436. An alignment guide or projection 437 is integrally formed with the body of the coupler 430. The guide 437 is aligned with the notch 562 of housing 540 when housing 540 is engaged with coupler 430.

The plate 440 is coupled to the upper portion 432 by fasteners, such as screws. The plate 440 includes an inner surface 442 that defines a receptacle 445 with inner surface 436. The receptacle 445 is configured to receive the housing 540 that is connected to the coupling portion 500. Coupled proximate to plate 440 are contact members 470 and 472 that provide contact surfaces for engagement with a support surface. The contact members 470 and 472 may be mounted using fasteners, such as screws.

The coupler 430 also includes a sleeve 450 that is configured to receive end 414 of lower portion 412 of side frame portion 400. The sleeve 450 includes a wall 452 that defines a receptacle 454 with an opening 456 into which the end 414 is inserted. The wall 452 also includes an opening 460 formed therein and defined by an edge 458. The opening 460 is configured to receive the coupler 419 of the lower portion 412.

Figure 30:
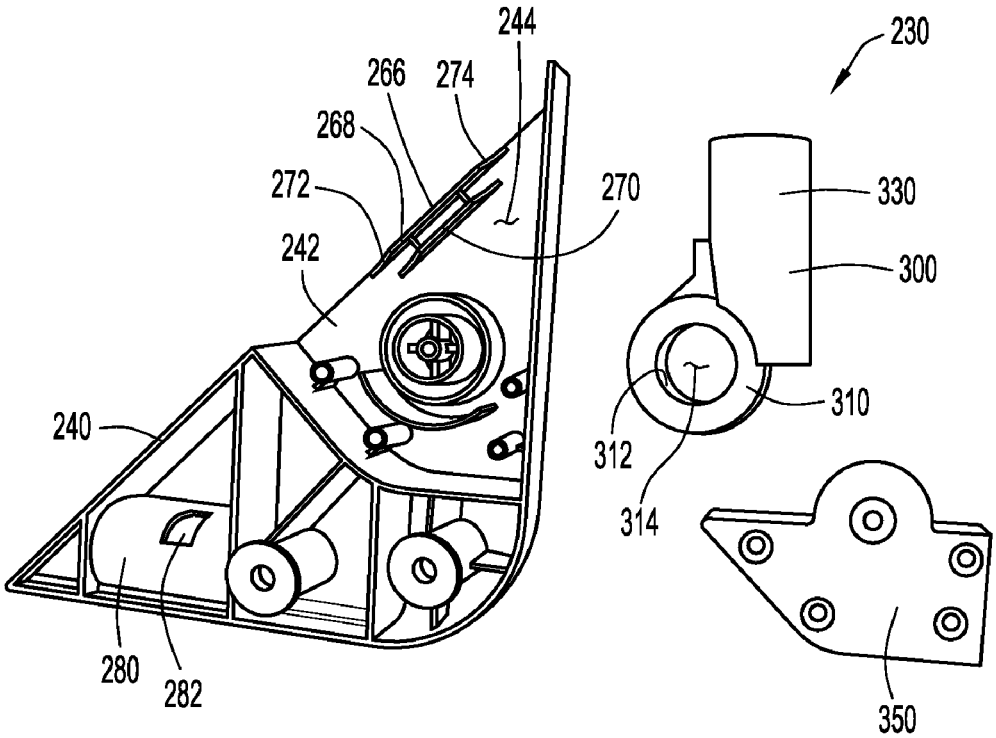
FIG. 30 is an exploded view of the coupler illustrated in FIG. 14.
Figure 31:
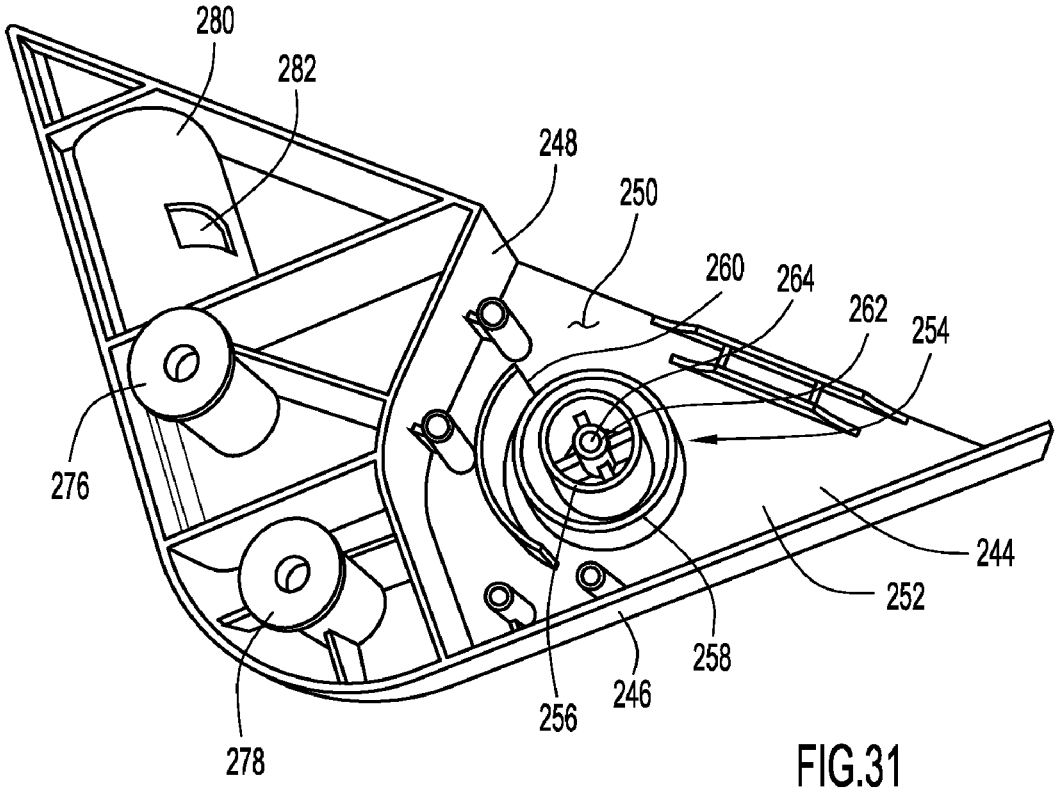
FIGS. 31 and 32 are bottom perspective views of a component of the coupler illustrated in FIG. 14.
Figure 32:
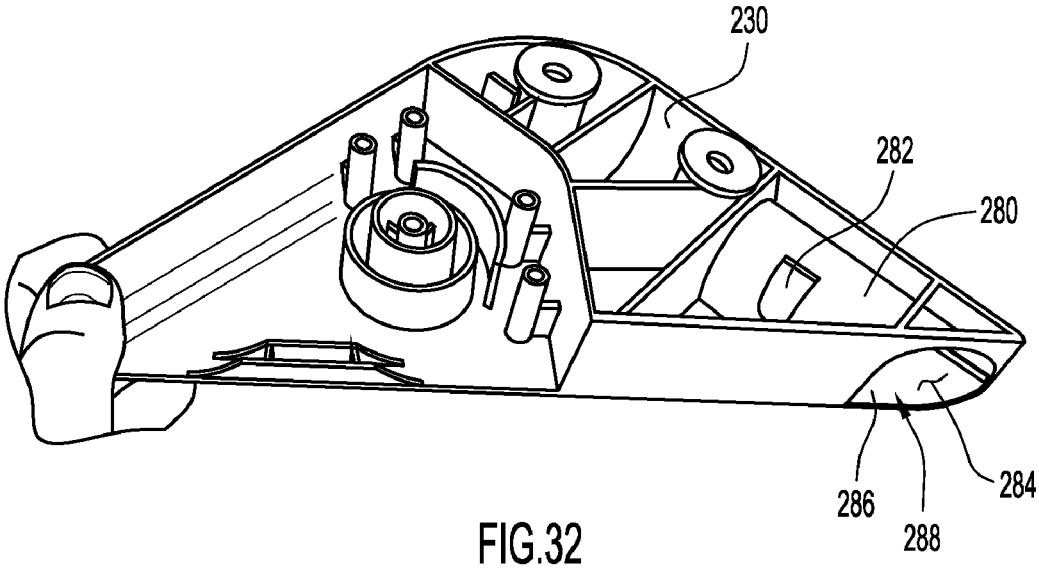

Referring to FIGS. 30-36, the various components of the coupler 230 are illustrated. In this embodiment, as shown in FIGS. 30-32, the coupler 230 includes a body 240 with an upper portion 242 with a lower side 244. As previously discussed, a positioner 266 with rails 268 and 270 having ends 272 and 274 is included on the upper portion 242. In addition, the sleeve 280 with opening 282 is shown. The sleeve has an inner surface 286 that defines a passageway 288 and an opening 284. Contact members 276 and 278 are connected to the coupler 230 using conventional fasteners, such as screws.

Referring to FIG. 31, the coupler 230 also includes a side portion or wall 246, an inner wall 248 and an inner surface 252, which collectively define a receptacle 250. A guide structure 254 is provided on the inner surface 252. The guide structure 254 includes an inner ring 256, an outer ring 258, and a limit 260. In the center of the inner ring 256 is a boss 262 with an opening 264 that is configured to receive a fastener that mounts the rotating member 300 to the coupler 230. The rings 256 and 258 form a guide for movement of the rotating member 300. The limit 260 functions to limit the extent of rotation of the rotating member 300.

Figure 33:
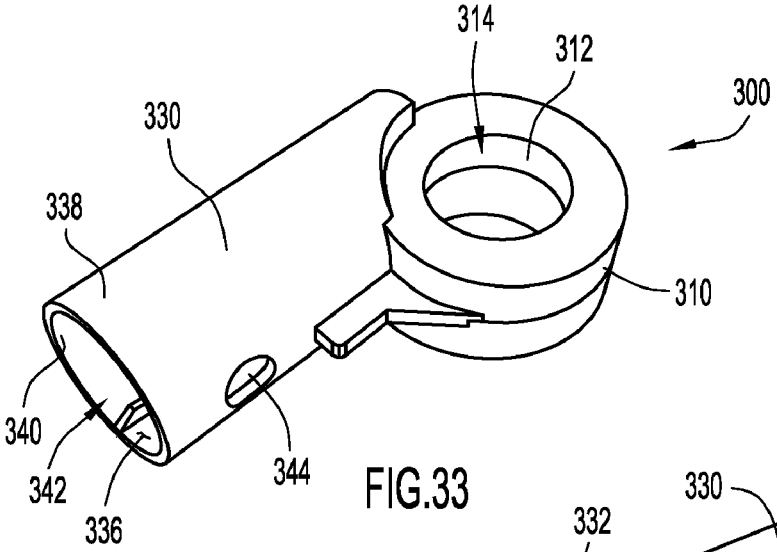
FIG. 33 is a top perspective view of the rotating portion of the coupler illustrated in FIG. 14.
Figure 34:
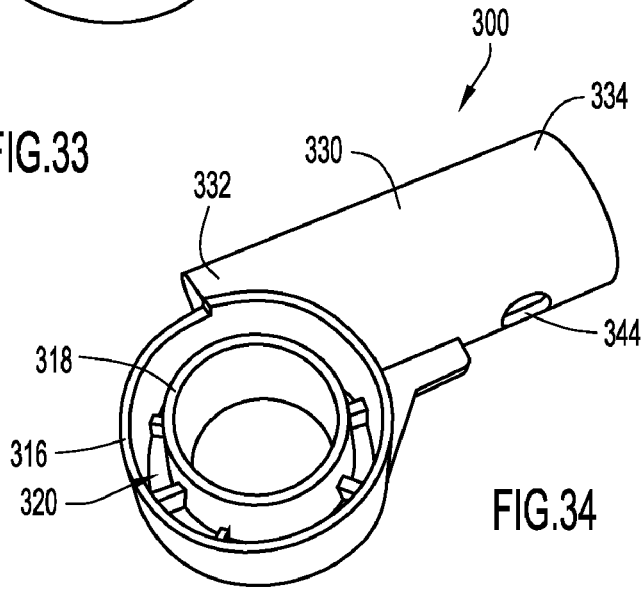
FIG. 34 is a bottom perspective view of the rotating portion illustrated in FIG. 33.

Referring to FIG. 30, the rotating member 300 includes a body or body portion 310 and a sleeve 330. The body 310 has an inner surface 312 that defines an opening 314. Referring to FIGS. 33 and 34, the body 310 on its lower surface includes an outer wall 316 and an inner wall 318 that define therebetween a channel or region 320. The sleeve 330 has opposite ends 332, which is closed, and 334, which is open. Proximate to end 334 is an opening 336 that is formed by the wall 338 of the sleeve 330. The inner surface 340 of the wall 338 defines a passageway 342 into which end 514 of the coupling portion 500 is inserted. The wall 338 includes an opening 344 configured to receive a coupler 516 as described above.

Figure 35:
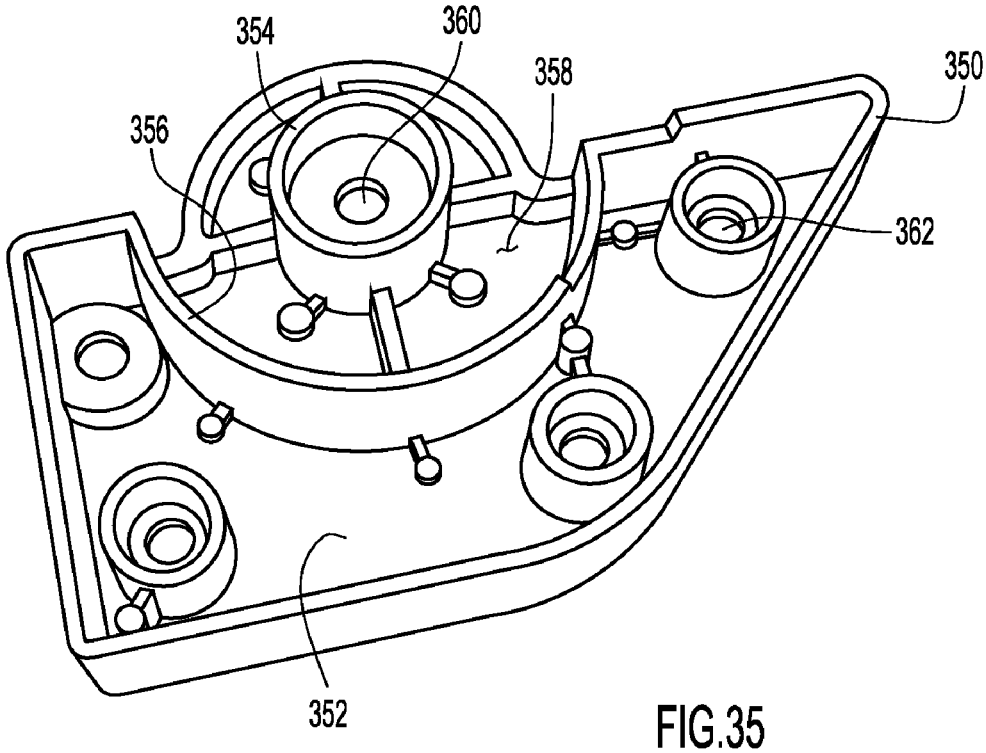
FIG. 35 is a bottom perspective view of a mounting portion of the coupler illustrated in FIG. 14.
Figure 36:
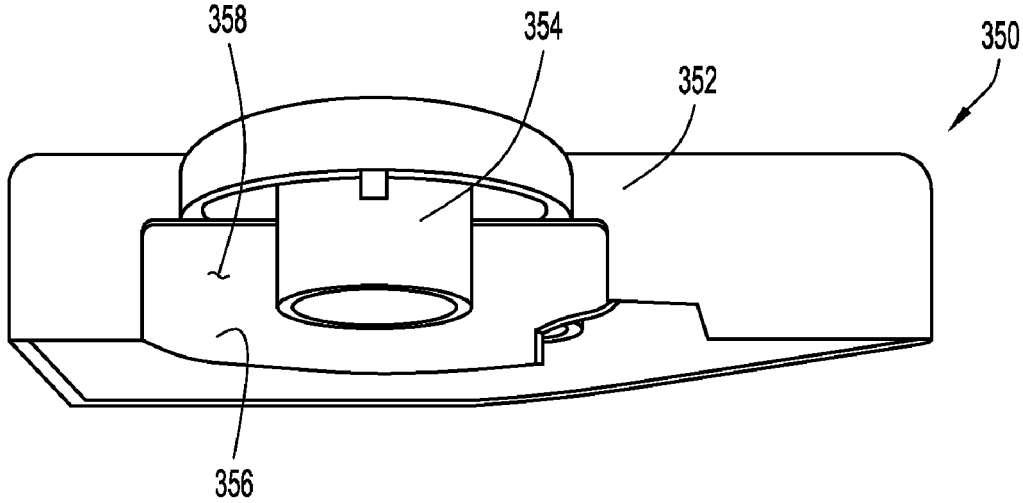
FIG. 36 is a side view of the mounting portion illustrated in FIG. 35.

Referring to FIGS. 35 and 36, various features of the mount 350 are illustrated. The mount 350 includes a body portion 352 with an inner wall or shoulder 354 formed on its inner surface. A wall 356 is provided which, together with wall 354 defines a channel 358. The channel 358 is configured to receive the upper portion of the body 310 of the rotating member 300. The body portion 352 includes an opening 360 through which a fastener, such as a screw, is inserted to secure the mount 350 and the rotating member 300 to the body 240 of the coupler 230. Several other openings 362 are provided for the insertion of fasteners to secure the mount 350 to the coupler body 240.

In one embodiment, the couplers 230 and 430 and the housing 540, including button 530, are formed of molded plastic. The elongate components of the side frame portions 200 and 400 are tubular metallic members.

Figure 37:
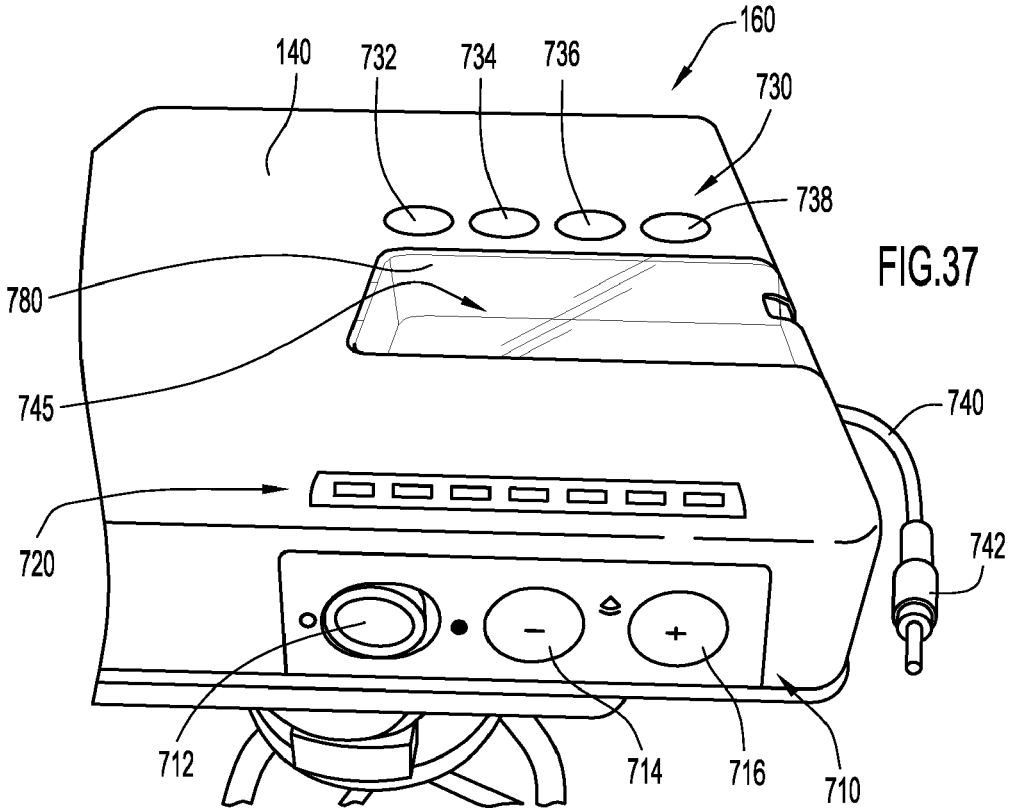
FIG. 37 is a top perspective view of a portion of the hub of the infant support structure illustrated in FIG. 3.

Referring to FIGS. 37-41, some of the components of the entertainment portion of the hub 140 according to the present invention are illustrated. In this embodiment, the hub 140 includes an entertainment portion 160 which has a control portion 730 with several push buttons 732, 734, 736, and 738 (see FIG. 40), which control the particular output, such as audible outputs, as well as the volume of the output. Referring to FIG. 37, the hub 140 includes a control portion 710 with several push buttons or switches 712 (on/off), 714 (swing decrease), and 716 (swing increase) that can be manipulated to control the function and operation of the swing.

The hub 140 includes a controller or processor with a power source and a speaker or transducer connected to the controller. Extending from an opening 162 (see FIG. 38) is a wire 740 that has a jack 742 coupled thereto. The jack 742 can be plugged into an electronic device, such as an audio player, mp3 player, IPOD, IPHONE, etc. The electronic device can be placed in the receptacle 745 that is formed in the hub or connector 140. A cover 780 is detachably coupled to the hub 140 to provide protection for any electronic device that is placed in the receptacle 745.

Figure 41:
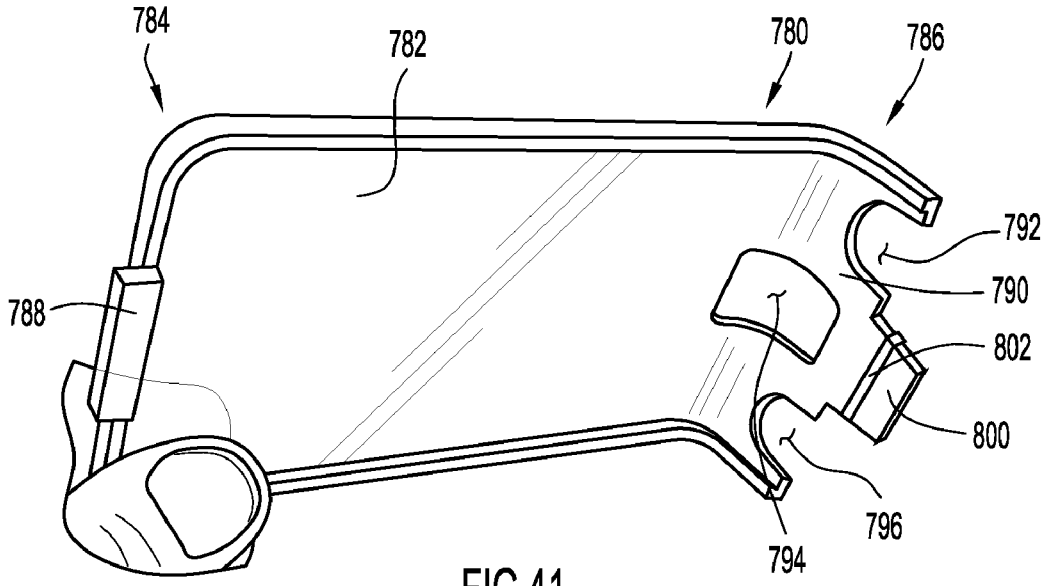
FIG. 41 is a perspective view of an embodiment of a cover according to the present invention.

Referring to FIG. 41, in this embodiment, the cover 780 includes a body or body portion 782 with ends 784 and 786. A mounting component 788 is coupled to end 784. The mounting component 788 is a projection that extends outwardly from the body 782. Proximate to end 786 is a plate 790 that has several openings or notches 792, 794, and 796 formed therein. The openings 792, 794, and 796 are provided so that the jack 742 can be aligned with and inserted into a port on the electronic device, regardless of whether the port is centrally located or located proximate to one of the side edges of the electronic device. The plate 790 includes an extension or tab 800 that has a detent or projection 802 thereon that forms a mounting portion.

Figure 38:
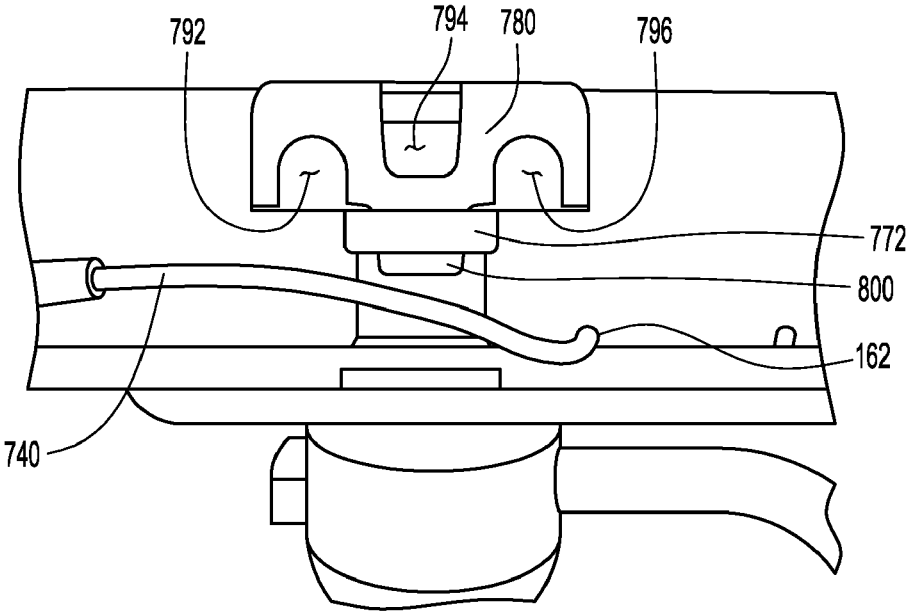
FIG. 38 is a side view of the portion of the hub illustrated in FIG. 37.
Figure 39:
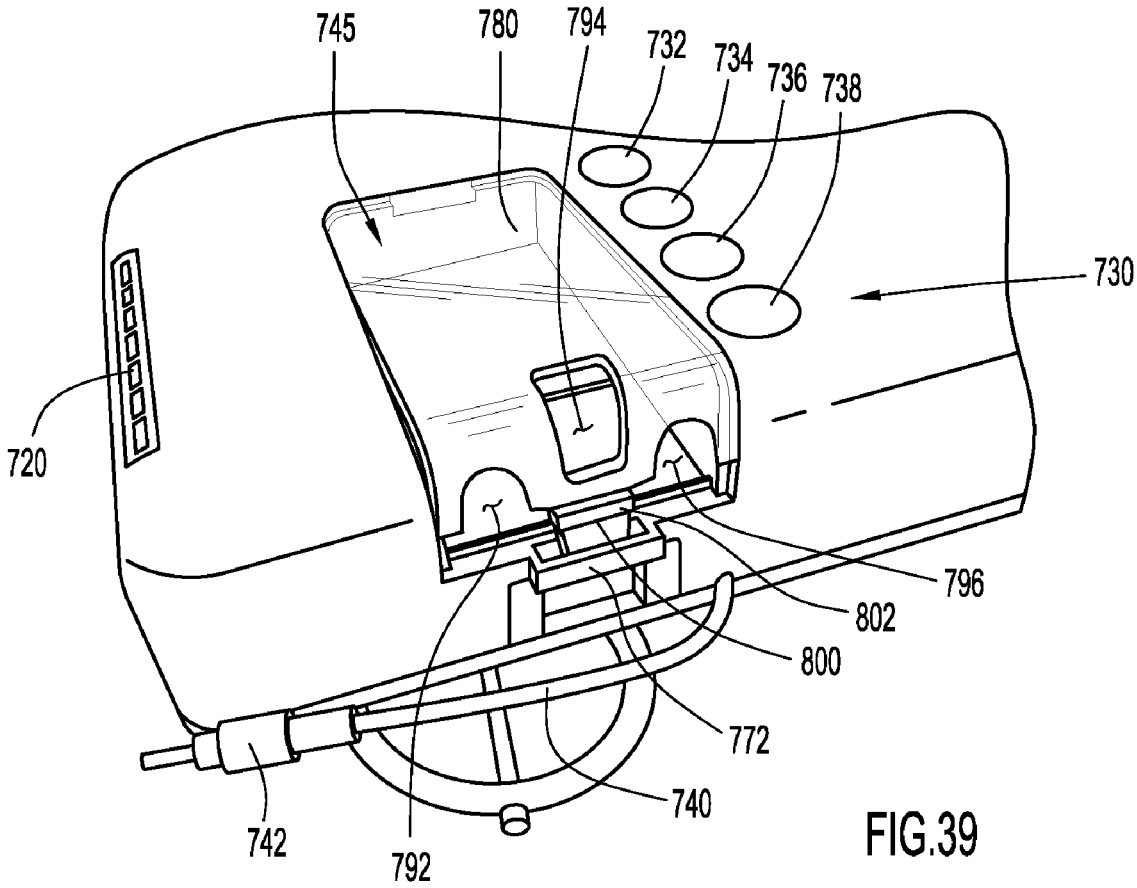
FIG. 39 is a perspective view of the portion of the hub illustrated in FIG. 37.
Figure 40:
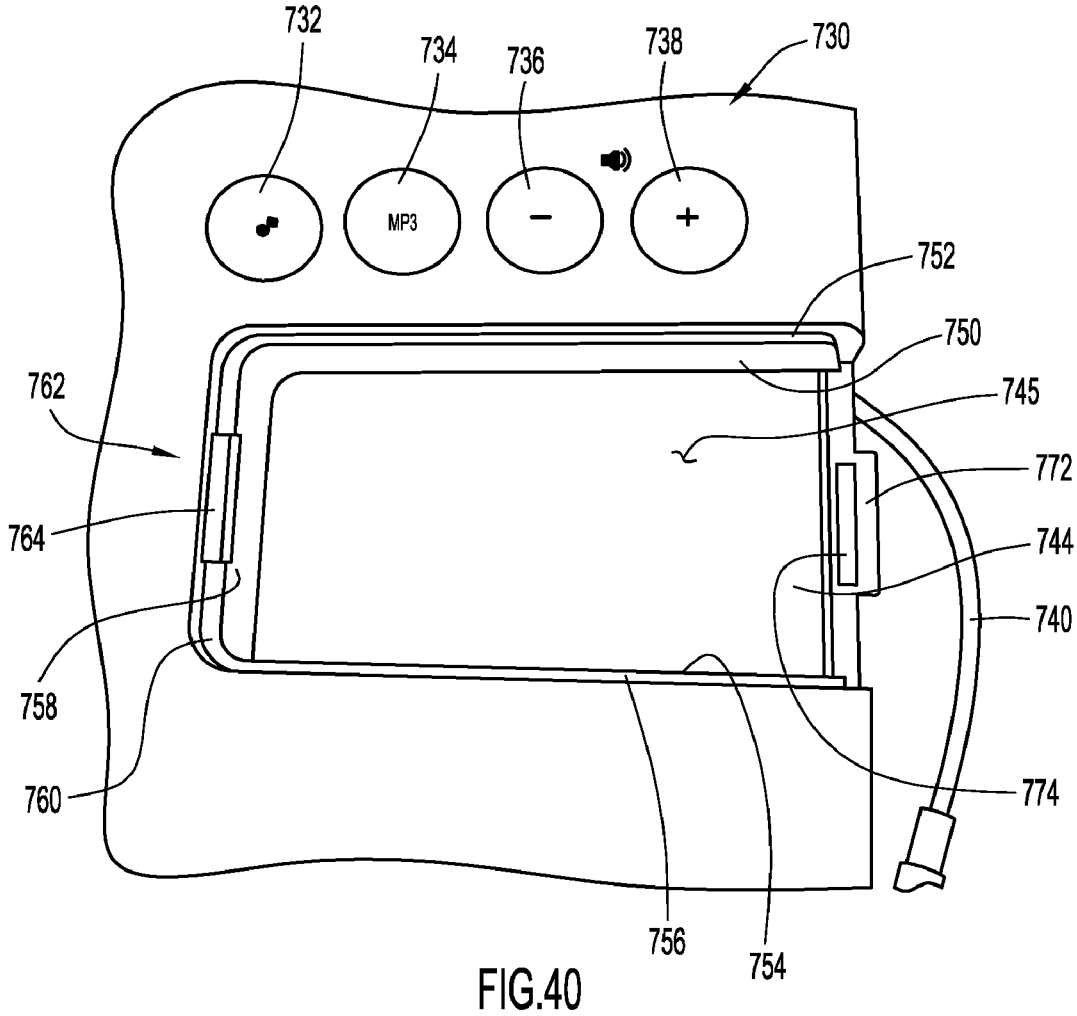
FIG. 40 is a top view of the portion of the hub illustrated in FIG. 37.

Referring to FIG. 40, the receptacle 745 is defined by side walls 750 and 754, end wall 758, and bottom wall 744. The side walls 750 and 754 and end wall 758 have upper surfaces 752, 756 and 760, respectively. In this embodiment, the upper surfaces 752, 756, and 760 are substantially aligned. In other embodiments, one or more of the upper surfaces 752, 756 and 760 may be offset from each other. Proximate to end wall 758 is a coupling area 762 that includes an opening or slot 764. The opening 764 is configured to receive projection 788. At the opposite end of the receptacle 745 is a bar 772 that defines a receiving area 774. Receiving area 774 is configured to receive tab 800. When tab 800 is moved downwardly enough, the projection 802 engages the bar 772 and couples the cover 780 to the hub 140 as shown in FIG. 38.

Thus, it is intended that the present invention cover the modifications and variations of this invention that come within the scope of the appended claims and their equivalents. For example, it is to be understood that terms such as "left," "right," "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration.

What is claimed is:

1. A collapsible frame for an infant support structure, the collapsible frame being positionable in a deployed configuration and in a collapsed configuration, the collapsible frame comprising:

a connector;

a first side portion, the first side portion being coupled to the connector;

a second side portion, the second side portion being movably coupled to the connector; and a coupling portion, the coupling portion being movably coupled to the first side portion and detachably coupled to the second side portion, the frame being positionable in a first position and in a second position, the coupling portion being coupled to the first side portion and the second side portion in the first position and configured to retain the frame in its deployed configuration, and the coupling portion being decoupled from the second side portion in the second position, the frame being movable from its deployed configuration to its collapsed configuration when in the second position.

2. The collapsible frame of claim 1, wherein the first side portion includes an upper portion and a lower portion, the upper portion of the first side portion is coupled to the connector, the second side portion includes an upper portion and a lower portion, the upper portion of the second side portion is coupled to the connector, and the coupling portion is coupled to the lower portion of the first side portion and detachably coupled to the lower portion of the second side portion.

3. The collapsible frame of claim 2, wherein the first side portion includes a first coupler coupled to the lower portion of the first side portion, the second side portion includes a second coupler coupled to the lower portion of the second side portion, and the coupling portion is pivotally coupled to the first coupler and detachably coupled to the second coupler.

4. The collapsible frame of claim 3, wherein the coupling portion includes a locking mechanism, the locking mechanism being configured to engage the second coupler to couple the coupling portion to the second coupler.

5. The collapsible frame of claim 2, wherein the lower portion of the first side portion, the lower portion of the second side portion, and the coupling portion are disposed within the same plane.

6. The collapsible frame of claim 1, wherein the second side portion is pivotally coupled to the connector and the first side portion is fixedly coupled to the connector.

7. The collapsible frame of claim 1, wherein the first side portion includes a distal end and the second side portion includes a distal end, the coupling portion being coupleable to the distal end of the first side portion and to the distal end of the second side portion.

8. The collapsible frame of claim 7, wherein the first side portion includes a tubular member and a coupler detachably coupled to the tubular member, the second side portion includes a tubular member and a coupler detachably coupled to the tubular member, the coupling portion being coupleable to the first side portion coupler and to the second side portion coupler.

9. An infant support structure, comprising:

a frame, the frame being positionable in a deployed configuration and in a collapsed configuration, the frame including:

an upper portion;

a lower portion, the lower portion of the frame being reconfigurable between a first configuration and a second configuration, the frame being in its deployed configuration when the lower portion is in its first configuration and the frame being movable from its deployed configuration to its collapsed configuration when the lower portion is in its second configuration; and a coupling portion, the coupling portion being movably coupled to the lower portion at a first end and detachably coupled to the lower portion at a second and opposite end, the second end being coupled to the lower portion in the first configuration and decoupled from the lower portion in the second configuration; and a support portion, the support portion being coupled to the upper portion of the frame, the support portion being configured to receive an infant therein.

10. The infant support structure of claim 9, wherein the lower portion of the frame is disposed within a plane and the reconfiguration of the lower portion of the frame from its first configuration to its second configuration occurs within the plane.

11. The infant support structure of claim 10, wherein the lower portion of the frame includes a first side portion and a second side portion, and the coupling portion is configured to be disposed between and connected to the first side portion and the second side portion.

12. The infant support structure of claim 11, wherein the coupling portion is positionable in a first position and in a second position, the frame is retained in its deployed configuration when the coupling portion is disposed in its first position, and the frame is movable from its deployed configuration to its collapsed configuration when the coupling portion is disposed in its second position.

13. The infant support structure of claim 11, wherein the first side portion includes an elongate member and a housing coupled to the elongate member, the second side portion includes its own elongate member and housing, the coupling portion is movably coupled to the housing of the first side portion, and the coupling portion is detachably coupled to the housing of the second side portion.

14. The infant support structure of claim 13, wherein the coupling portion includes a locking mechanism, and the housing of the second side portion is configured to receive a portion of the locking mechanism to secure the coupling portion to the second side portion.

15. The infant support structure of claim 10, wherein the lower portion includes a first distal end and a second distal end, the coupling portion being coupleable to the first distal end and to the second distal end.

16. The infant support structure of claim 15, wherein the coupling portion is detachably coupled to the first distal end and to the second distal end.

17. An infant support structure, comprising:

a support portion, the support portion being configured to receive an infant; and a collapsible frame, the frame being configured to movably support the support portion, the frame being positionable in a deployed configuration and in a collapsed configuration, the frame including:

a first portion;

a second portion, the second portion being movable relative to the first portion, the first portion and the second portion being spaced apart from each other when the frame is in its deployed configuration and being proximate to each other when the frame is in its collapsed configuration; and a locking portion, the locking portion having a first end and an opposite second end, the first end of the locking portion being movably coupled to the first portion and the second end of the locking portion being detachably coupled to the second portion, the locking portion being disposed between the first portion and the second portion to maintain the frame in its deployed configuration, the frame being movable to its collapsed configuration when the second end of the locking portion is decoupled from the second portion.

18. The infant support structure of claim 17, wherein the frame includes a hub, the first portion of the frame is fixedly coupled to the hub, the second portion of the frame is pivotally coupled to the hub, and the locking portion is movably coupled to the first portion and detachably coupled to the second portion.

19. The collapsible frame of claim 17, wherein the first portion includes a distal end and the second portion includes a distal end, the locking portion being coupled to the distal end of the first portion and to the distal end of the second portion.

20. The collapsible frame of claim 2, wherein the coupling portion has a first end and an opposite second end, the first end of the coupling portion being movably coupled to the first side portion and the second end of the coupling portion being detachably coupled to the second side portion.

* * * * *